US012534833B2

(12) United States Patent
Spada et al.

(10) Patent No.: US 12,534,833 B2
(45) Date of Patent: Jan. 27, 2026

(54) CIRCULAR KNITTING MACHINE WITH ASSEMBLY FOR NEEDLE AND SINKER SELECTION

(71) Applicant: SANTONI S.P.A., Brescia (IT)

(72) Inventors: Lionello Spada, Brescia (IT); Maurizio Lodrini, Brescia (IT); Andrea Lonati, Brescia (IT)

(73) Assignee: SANTONI S.P.A., Brescia (IT)

( * ) Notice: Subject to any disclaimer, the term of this patent is extended or adjusted under 35 U.S.C. 154(b) by 0 days.

(21) Appl. No.: 18/575,068

(22) PCT Filed: Jun. 13, 2022

(86) PCT No.: PCT/IB2022/055453
§ 371 (c)(1),
(2) Date: Dec. 28, 2023

(87) PCT Pub. No.: WO2023/281334
PCT Pub. Date: Jan. 12, 2023

(65) Prior Publication Data

US 2024/0301598 A1 Sep. 12, 2024

(30) Foreign Application Priority Data

Jul. 8, 2021 (IT) ..... 102021000018056

(51) Int. Cl.
*D04B 15/06* (2006.01)
*D04B 9/00* (2006.01)
*D04B 15/24* (2006.01)

(52) U.S. Cl.
CPC ..... *D04B 15/06* (2013.01); *D04B 9/00* (2013.01); *D04B 15/24* (2013.01)

(58) Field of Classification Search
CPC ..... D04B 15/06; D04B 15/24; D04B 15/32; D04B 15/327; D04B 15/82; D04B 15/84; D04B 9/12; D04B 9/38; D04B 9/46
See application file for complete search history.

(56) References Cited

U.S. PATENT DOCUMENTS 611,751 A * 10/1898 Gearhart ..... D04B 9/20 66/115
2,134,480 A * 10/1938 Houseman ..... D04B 9/26 66/107

(Continued)

FOREIGN PATENT DOCUMENTS

EP 0547526 A2 6/1993
GB 526120 A * 9/1940 ..... D04B 9/38

OTHER PUBLICATIONS

International Search Report and Written Opinion dated Sep. 22, 2022 in corresponding International Application No. PCT/IB2022/055453, 15 pages.

*Primary Examiner* — Aiying Zhao
(74) *Attorney, Agent, or Firm* — MH2 TECHNOLOGY LAW GROUP LLP

(57) ABSTRACT

A circular knitting machine for knitwear, comprising a needle-holding cylinder, having longitudinal grooves housing a plurality of needles, and a needle-holding ring, having radial grooves housing a plurality of holding-down sinkers, and wherein each needles is paired with an adjacent sinker to form a needle-sinker assembly; the knitting machine comprises, for each needle-sinker assembly, a pre-selection element paired with the respective needle and comprising a connecting portion selectively cooperating with the sinker belonging to the same needle-sinker assembly; each radial groove has a rear section and a front section; the front (Continued)

section is wider than the rear section and configured for laterally containing and guiding the connecting portion of the pre-selection element.

14 Claims, 13 Drawing Sheets

(56) References Cited

U.S. PATENT DOCUMENTS

| | | | | |
|---|---|---|---|---|
| 2,607,206 | A * | 8/1952 | St Pierre | D04B 15/10 66/115 |
| 2,873,595 | A * | 2/1959 | Shortland | D04B 15/10 66/115 |
| 4,519,221 | A * | 5/1985 | Hirano | D04B 1/26 66/93 |
| 5,335,518 | A * | 8/1994 | Lonati | D04B 15/06 66/93 |
| 2005/0081569 | A1 | 4/2005 | Lonati et al. | |

* cited by examiner

FIG.13
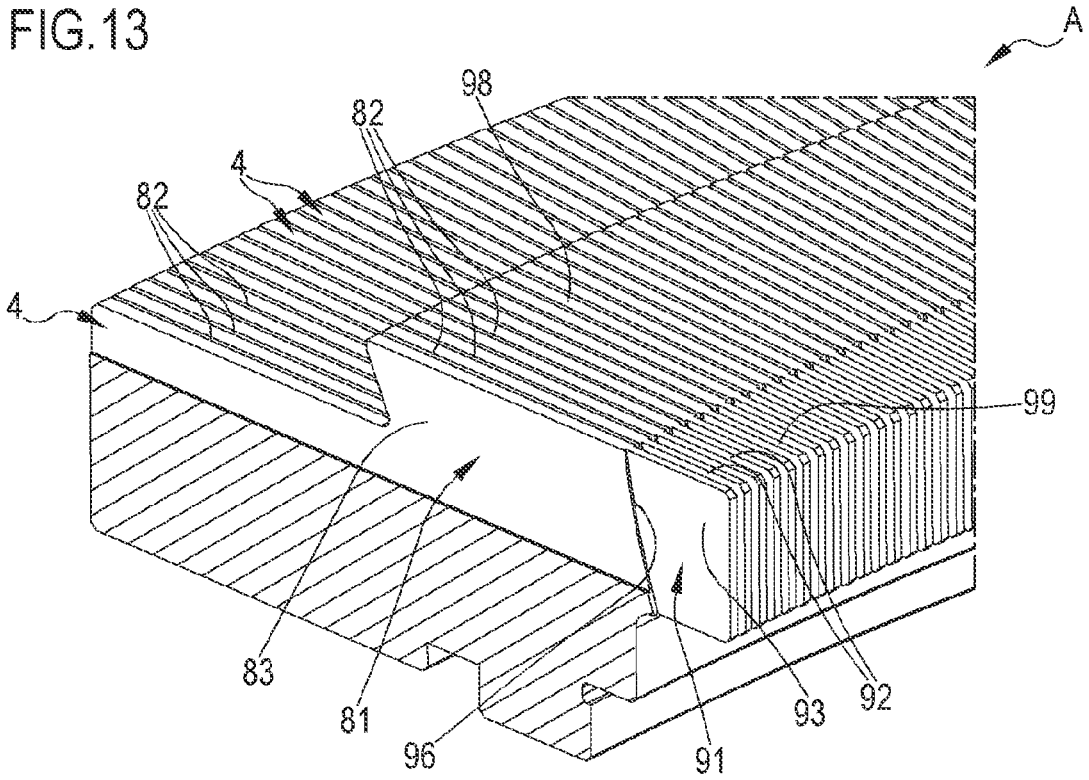
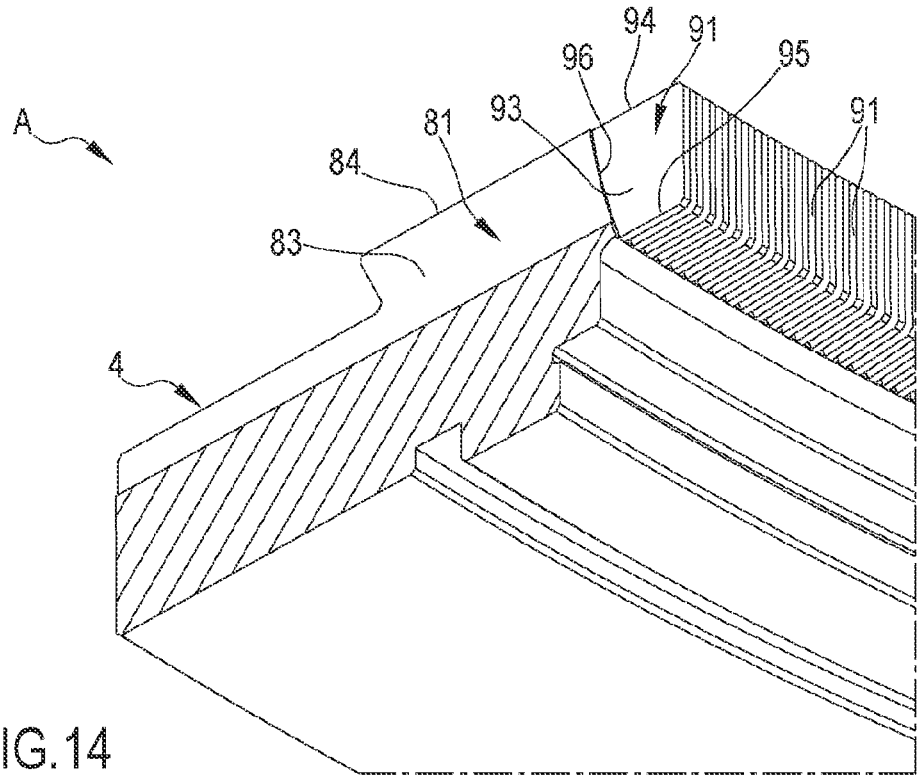
FIG.14

CIRCULAR KNITTING MACHINE WITH ASSEMBLY FOR NEEDLE AND SINKER SELECTION

CROSS-REFERENCE TO RELATED APPLICATIONS

This application is a U.S. National Stage application of PCT/IB2022/055453, filed Jun. 13, 2022, pending, which claims priority to Italian Patent Application No. 102021000018056, filed Jul. 8, 2021, the entire disclosures of which are hereby incorporated by reference in their entireties.

FIELD OF THE INVENTION

The present invention relates to a circular knitting machine for knitwear. In further detail, the present invention relates to a knitting machine provided with special "needle-sinker assemblies" comprising specific elements and able to manufacture knitted fabric according to different modes. In the context of the present invention, the structure and operation of those elements which, by cooperating with the needles and in particular with the knockover sinkers, allow to make an individual sinker selection enabling to generate special stitches by cooperating with some needles only while adjacent needles make traditional stitches, shall further be described.

The present invention further relates to a method for knitting in a circular knitting machine for knitwear and to a needle-sinker assembly for circular knitting machines for knitwear.

The present invention further relates to a circular knitting machine for knitwear equipped with a special needle-holding ring provided with radial grooves having a specific shape.

Preferably, the present invention falls into the technical field of circular knitting machines for knitted items, seamless knitted items, hosiery items and the like.

In the present text the wording "knitting machine" generally means a circular knitting machines apt to manufacture knitted items and provided with at least one needle-holding unit or needle-holding cylinder turnably mounted in a supporting structure of the machine and supporting a plurality of needles moving parallel to an axis of rotation of the needle-holding cylinder so as to produce a weft knitted fabric. Moreover, the knitting machine is provided with a plurality of yarn feeding points or knitting "feeds", in which the needles of the machine are supplied with yarn. This knitting machine can be e.g. single or double needlebed. Circular knitting machines can comprise a variable number of feeds, e.g. 1, 2, 4, 6, 8 or more knitting feeds.

BACKGROUND OF THE INVENTION

As is known, circular knitting machines comprise a needle-holding element (needle cylinder and/or plate) on which one or more series of needles are arranged along a circular path (circular needlebeds), for knitted fabric formation. Knockover sinkers are arranged in radial grooves obtained in a ring-shaped body (sinker crown or ring) arranged around the needle-holding cylinder, and these sinkers cooperate with the needles so as to make knitted fabric.

The needle-holding cylinder is placed vertically and is equipped with a plurality of axial grooves, each housing slidingly in a direction parallel to the needle axis a respective needle provided with a butt radially protruding from the corresponding groove. Around the needle-holding cylinder are arranged actuating cams defining paths that can be engaged by needle butts when the cylinder is actuated in rotation around its axis with respect to the needle actuating cams. The paths defined by the actuating cams are shaped so as to cause, during the rotation of the needle cylinder around its axis, a movement of the needles along the corresponding axial grooves which leads the needle tip to get out above of the upper end of the needle-holding cylinder so as to catch the yarn, or yarns, provided on a feed of the machine and then to get back into the cylinder, thus causing the formation of the new knitted loops linked up to the loops previously formed, which are knocked over by the needles and descend into the cylinder. The actuating cams of the needles also define paths preventing this movement of the needles and maintain them inside the cylinder grooves so as to prevent them from catching the yarn provided to a feed, thus excluding them from the current knitting process.

The actuation, or exclusion, of the needles on a yarn feed is obtained by means of selecting devices causing a movement of the needles along the corresponding axial grooves of the cylinder, so as to cause the transition of the needle butt from one path to another one among those defined by the actuating cams.

Some known selecting systems comprise a selector arranged in each axial groove of the needle-holding cylinder below the respective needle and provided with a butt developing in a radial direction with respect to the needle-holding cylinder. Each selector can be oscillated in a plane radial to the cylinder so as to switch from a non-operating position, in which it lies with its butt inside the corresponding groove, to an operating position, in which such a butt protrudes radially from the corresponding groove so as to engage with actuating cams of the selectors, which, like the actuating cams of the needles, are arranged around the needle-holding cylinder and exhibit ascending an descending portion so as to cause the movement of the selectors along the corresponding axial grooves in a direction parallel to the axis of the needle-holding cylinder during the rotation of the cylinder with respect to the actuating cams. The selectors are switched from the operating to the non-operating position by means of various devices facing outside the needle-holding cylinder and interfering, or not interfering, depending on the actuation imparted, with suitable tags of the selectors so as to place them in the operating or non-operating position.

The sinker ring, placed near the upper end of the needle-holding cylinder, exhibits the radial grooves (housing the knockover sinkers) angularly offset with respect to the axial grooves of the needle-holding cylinder. The sinkers can slide along a radial direction with respect to the needle-holding cylinder and to this end are equipped with a butt protruding above from the radial grooves of the sinker ring; the butt engages into a path defined by actuating cams of the sinkers, causing a cyclic movement of the sinkers approaching or getting away with respect to the axis of the needle-holding cylinder. This movement leads the sinkers with their front end, shaped as a plane, between to adjacent needles so that the yarn, or yarns, hooked by the needles rests upon this front end while the needles get back into the grooves of the needle-holding cylinder causing the formation of new knitted loops.

For special stitches, such as e.g. terry stitches, special sinkers are used, which are equipped with two plane portions, at a distance from each other in a direction parallel to the axis of the needle-holding cylinder and separated one from the other by means of a spring. These sinkers are moved radially towards the axis of the needle-holding cylinder when the adjacent needles have begun their descent for catching at least two yarns and linking them to a knitting feed, so that the spring of the sinker gets between these two yarns and causes a yarn to rest upon a holding-down plane and the other yarn upon the other plane, thus forming terry stitches.

Known knitting machines allow to execute designs fully made up of terry stitches, or designs with portions having terry stitches alternating with portion with regular stitches. In the latter case, long butt sinkers and short butt sinkers are arranged in the sinker ring, so as to actuate separately the two types of sinkers and obtain an alternation of plain or terrycloth knitted fabric.

Document EP0547526 discloses a circular knitting machine equipped with a needle-holding cylinder and with a ring holding sinkers provided with two holding-down planes at a distance from each other, for the formation of terry stitches as described above. The knitting machine is further equipped with "auxiliary jacks" housed individually in the axial grooves near the needles and movable upon control parallel to the axis of the needle cylinder so as to act with their upper end upon the holding-down sinkers for their movement along a direction radial to the needle cylinder from a recessed position, causing two yarns hooked by the adjacent needles to rest upon the same plane of the two holding-down planes for forming loops with two yarns having the same length, to an advanced position in the direction of the needle cylinder, causing two yarns hooked by the adjacent needles to rest upon the one and the other of the two holding-down planes, respectively, for forming loops with two yarns having a different length (i.e. terry stitches).

In EP0547526 the holding-down sinkers have on their back a recess with a portion having a plane inclined with respect to the longitudinal axis of the sinkers, and the auxiliary jacks have their upper end shaped as an inclined plane, too: thus the upper end of the jack, when the latter rises vertically, acts upon the portion with an inclined plane of the sinkers above so as to cause them to move along a direction radial to the needle-holding cylinder from the recessed position, causing the formation of knitted loops with two yarns having the same length, to the advanced portion, causing the formation of loops with two yarns having a different length. Basically, the coupling between the two inclined planes of the jack and the respective sinker allows to move the sinker radially, as a result of a vertical shift of the jack, to as to make different stitches; the ascent of the jack corresponds to a horizontal movement of the sinker. It should be pointed out that the ascent of the jack, so as to push on the portion with an inclined plane of the respective sinker, is controlled by means of cams, located outside the needle-holding cylinder, which act upon a butt of the jack.

Document U.S. Pat. No. 3,877,258 describes a circular knitting machine for knitwear and discloses in particular a technical solution in which the needle is provided with a protrusion against which a tab of the sinker abuts so that, as long as the needle is in its raised position, the sinker cannot get in and approach the cylinder axis. When the needle descends, the tab of the sinker does not stop against the pin of the needles and the action of a spring pushes the sinker inside, so as to cause it to get it and thus make terry stitches.

Document DE2642079 describes a circular knitting machine for knitwear equipped with needles and sinkers, in which a sequence of vertically shifting elements is present, the upper one engaging a foot (i.e. a lower end) of the sinker so as to cause to swing between an outer position, in which the sinker is taken out and has its own knitting plane taken out of the needle-holding cylinder, and an inner position, in which the sinker is in so that its knitting plane is placed between two adjacent needles so as to receive the yarns resting thereon and cooperate in stitch formation. DE2642079 then describes an in-out actuation of the sinker as a result of a vertical movement, this actuation is caused by a sequence of selecting elements and does not depend on the movement of the needle.

SUMMARY

In the framework of circular knitting machines as the ones disclosed above, the Applicant has identified the presence of some drawbacks.

First of all, the Applicant noticed that the operation of the knitting machine according to known solutions can be improved under various aspects.

For instance, known knitting machines do not allow to individually select holding-down sinkers so that they make special stitches on given needles only.

The Applicant noticed that known machines as described above have limited possibilities to select and control the elements participating in stitch formation, in particular the holding-down sinkers, and this limits manufacturing flexibility.

Globally, in known solutions the possibilities to execute special stitches, such as e.g. terry stitches, are strongly limited due to a rigid operation of the elements participating in stitch formation, i.e. needles and sinkers. Known solutions enable to select for each needle the respective sinker (e.g. by means of the vertical movement of the jack as described in EP0547526), however it is not possible to activate or not, in a selective manner, the insertion movement of the single sinker, so as to execute a specific stitch among those that can be made with the sinker itself.

This means that plain and special stitches (such as e.g. terry stitches) cannot be alternated as desired, for each needle and in each knitted course.

Under these circumstances, an aim underlying the present invention in its various aspects and/or embodiments is to provide a circular knitting machine which can obviate one or more of the drawbacks referred to above.

A further aim of the present invention is to provide a circular knitting machine for knitwear which allows to manufacture knitted fabrics with stitches having the most different features e in the desired positions.

A further aim of the present invention is to provide a circular knitting machine for knitwear which allows to make a "needle-by-needle" selection of the single sinkers, i.e. an individual selection of the sinkers so as to make with them special stitches in the desired positions only.

Moreover, an aim of the present invention is to propose a circular knitting machine for knitwear which can create for each knitted course any alternation of different stitches, i.e. desired sequences of plain and special stitches, which enable to obtain "patterns" with special stitches having even complex profiles and shapes.

Moreover, an aim of the present invention is to propose a circular knitting machine for knitwear which can manufacture high quality knitted fabrics.

A further aim of the present invention consists in proposing a circular knitting machine for knitwear and a method for knitting which allow to increase the plurality of movements which can be assigned to the elements participating in stitch formation, in particular to the holding-down sinkers, so as to achieve a higher production flexibility, i.e. so as to manufacture different types of fabrics with several characteristics differing one from the other.

A further aim of the present invention is to provide a circular knitting machine for knitwear characterized by a higher versatility for manufacturing knitted fabrics than known solutions.

An aim of the present invention is also to propose a circular knitting machine for knitwear having a rational structure and specifically conceived for achieving given performance when manufacturing the knitted fabric.

A further aim of the present invention is to provide a low cost circular knitting machine for knitwear which is easy to carry out.

A further aim of the present invention is to provide a knitting machine which is able to manufacture knitted fabrics and obtain further motifs and/or effects on the knitted fabric, preferably without having to reconfigure the machine itself or parts of it from a mechanical point of view.

A further aim of the present invention is to create alternative solutions to the prior art for carrying out circular knitting machines for knitwear and implementing knitting methods, and/or to open new design possibilities.

These and other possible aims, which shall appear better from the following description, are basically achieved by a circular knitting machine for knitwear, by a knitting method and by a needle-sinker assembly for circular knitting machine, according to one or more of the appended claims and according to the following aspects and/or embodiments, variously combined, possibly also with the aforesaid claims.

In the present description and in the appended claims, the words "upper", "lower", "above", "below", "horizontal", "vertical" relate to the positioning of the machine during normal operation with the central axis of rotation in vertical position and the cylinder needles with their heads pointing upwards.

In the present description and in the appended claims, the words "axial", "longitudinal", "circumferential", "radial" relate to said central axis.

Some aspects of the invention are listed below.

In a first aspect thereof, the present invention relates to a circular knitting machine for manufacturing knitted fabric, comprising:

- a needle-holding cylinder having a plurality of longitudinal grooves arranged around a central (vertical) axis of the needle-holding cylinder;
- a plurality of needles, each being movably (slidingly) housed in a respective longitudinal groove and configured for moving in a controlled manner inside the longitudinal groove;
- a sinker-holding ring placed near an upper end of the needle-holding cylinder and coaxial therewith, the sinker-holding ring having a plurality of radial grooves arranged around the central axis and, in use, being integral with the needle-holding cylinder;
- a plurality of holding-down sinkers, each being movably (slidingly) housed, at least partially, in a respective radial groove and configured for moving in a controlled manner inside the radial groove.

In one aspect, the radial grooves are angularly offset with respect to the longitudinal grooves, so that a circumferential alternation of longitudinal grooves and radial grooves is present around the central axis, and wherein each needle is paired with at least one respective adjacent sinker thus forming a needle-sinker assembly, the knitting machine globally comprising a plurality of needle-sinker assemblies.

In one aspect, the circular knitting machine comprises, for each needle-sinker assembly of said plurality of needle-sinker assemblies, or for each of the needle-sinker assemblies of a sub-set of needle-sinker assemblies:

- a pre-selection element, paired or operatively associated with the respective needle and comprising a connecting portion configured for selectively cooperating (either directly or indirectly) with said at least one adjacent sinker belonging to the same needle-sinker assembly;
- an activation element, paired or operatively associated with said pre-selection element and comprising an operating portion.

In one aspect, the pre-selection element is vertically movable, as a result of an ascending motion of the respective needle, to a pre-selection configuration in which said connecting portion is engaged into a connecting seat defined in the sinker belonging to the same needle-sinker assembly, thus causing a pre-selection of the sinker with the ascending motion of the corresponding needle.

In one aspect, the activation element is horizontally movable, towards said central axis, until pushing the pre-selection element belonging to the same needle-sinker assembly, so that the connecting portion of the pre-selection element, when (and if) engaged into the connecting seat of the sinker, causes in its turn a movement of the sinker in the radial groove towards the central axis, thus performing an activation (selection) of the sinker.

In one aspect, the activation element is horizontally movable, towards said central axis, as far as an activation (selection) position in which the operating portion of the activation element acts upon the pre-selection element belonging to the same needle-sinker assembly.

In one aspect, the pre-selection element is shaped so that the connecting portion is aligned with the respective activation element.

In one aspect, the pre-selection element is movably housed, at least partially, in the same longitudinal groove of the respective needle.

In one aspect, the connecting portion laterally rises from the longitudinal groove so as to be co-planar with the radial groove housing said at least one adjacent sinker belonging to the same needle-sinker assembly.

In one aspect, the activation element is movably housed, at least partially, in the same radial groove housing said at least one adjacent sinker belonging to the same needle-sinker assembly.

In one aspect, said activation of the sinker by the activation element causes the movement (insertion) of the sinker as far as given activation position in which the sinker executes a specific operation while knitting.

In one aspect, the knitting machine comprises:

- control cams of the needle-holding cylinder arranged around the needle-holding cylinder and movable with respect to said needle-holding cylinder around the central axis for causing or allowing the axial movement of the needles along the longitudinal grooves so as to enable stitch formation by said needles;
- control cams of the sinkers arranged on a sinker cover, placed on the sinker-holding ring, and movable with respect to said sinker-holding ring around the central axis for causing or allowing the horizontal movement of the sinkers along the radial grooves so as to cooperated to enable stitch formation by said sinkers.

In one aspect, said needle-holding cylinder and said sinker-holding ring are configured for rotating, during use, around said central axis, said control cams of the needle-holding cylinder and said control cams of the sinkers being, during use, stationary with respect to the needle-holding cylinder and of the sinker-holding ring (which are typically integral with the frame of the knitting machine).

In one aspect, each needle is provided with a butt radially protruding from the corresponding longitudinal groove and to be engaged into paths defined by needle cams belonging to said control cams of the needle-holding cylinder, so that the needle axially moves with respect to the respective longitudinal groove according to a given law of motion.

In one aspect, the aforesaid needle ascent is determined by the shape of said paths defined by the needle cams.

In one aspect, the pre-selection element is shaped as a flat bar and comprises:

a shaft;

the aforesaid connecting portion, preferably developing from an upper end of said shaft and to be positioned, at least partially, on the same lying plane of the radial groove housing said adjacent sinker belonging to the same needle-sinker assembly;

an actuating portion, lying in the same longitudinal groove of the respective needle and preferably defined on a lower end of said shaft, the actuating portion being configured for interacting with the respective needle during its ascending motion.

In one aspect, the connecting portion is bent/inclined with respect to the shaft, thus being laterally offset with respect to the shaft itself, so that the shaft lies on a respective plane while the connecting portion lies (at least partially) on a different plane, laterally distanced with respect to the plane on which the shaft lies.

In one aspect, the pre-selection element may exhibit in all its parts a basically constant thickness.

In an alternative aspect, the connection portion of the pre-selection element has a greater thickness than the shaft.

In one aspect, the pre-selection element has a junction portion placed between the shaft and the connecting portion, on which a bend causing the lateral offset of the connecting portion with respect to the shaft is defined.

In a possible embodiment, the shaft, the connecting portion and the actuating portion have a first, basically constant, thickness, whereas the junction portion between the shaft and the connecting portion has a second thickness which is smaller than the first thickness.

In one aspect, with the assembly mounted, said shaft of the pre-selection element lies in the same longitudinal groove as the respective needle.

In one aspect, with the assembly mounted, the connecting portion lies in the same plane as the radial groove housing the adjacent sinker belonging to the same needle-sinker assembly.

In one aspect, the needle comprises a pushing portion placed, with the needle-sinker assembly positioned in the knitting machine, below said actuating portion of the pre-selection element, said pushing portion being configured for getting in contact, from below and at a given vertical contact height reached by the needle during its ascending motion, with a lower surface of the actuating portion of the pre-selection element, so that a following and further ascending motion of the needle causes a corresponding ascending motion of the whole pre-selection element until reaching said pre-selection configuration.

In one aspect, the sinker comprises an elongated-plate body having:

in an intermediate area of development of said body, a butt and a counter-butt both developing transversally on one side of said body;

at a front end of said body, a functional portion configured for interacting with the yarns fed to the knitting machine;

the aforesaid connecting seat, configured like a hollow space preferably on the side of said body opposed with respect to said butt and said counter-butt, said hollow space being configured for receiving inserted therein said connecting portion of the pre-selection element when the latter reaches the pre-selection configuration.

In one aspect, the control cams of the sinkers, arranged on the sinker cover, comprise a sinker cam defining a sinker path in which the aforesaid butt and/or the aforesaid counter-butt of the sinker engage so as to guide the movement thereof, inside the respective radial groove, approaching or away from the central axis of the needle-holding cylinder according to a law of basic motion, so as to execute a basic movement.

In one aspect, the cam moves the sinker radially towards the central axis pushing against the counter-butt, and moves the sinker radially away from the central axis acting upon (pushing against) the butt.

In one aspect, said law of basic motion causes a cyclical movement of the sinkers leading said functional portion to be placed between two adjacent needles so that the yarn, or yarns, caught by the needles cooperate with the functional portion of the sinker, while the needles get back into the longitudinal grooves of the needle-holding cylinder, so as to execute a basic knitted design.

In one aspect, said basic knitted design corresponds to the formation of plain knitted loops.

In one aspect, the functional portion of the sinker comprises a basic plane designed, when the butt and/or the counter-butt engage said cam path defining the law of basic motion, to be placed between two adjacent needles so as to receive the yarn, or yarns, resting thereon, hooked by the needles getting back into the longitudinal grooves of the needle-holding cylinder, for making plain stitches.

In one aspect, said basic plane of the sinker is a "knitting plane", i.e. the plane in which the yarn, or yarns, is placed during stitch formation.

In one aspect, each sinker is configured for executing said basic movement regardless of the fact that the corresponding pre-selection element is or not in said pre-selection configuration, i.e. regardless of the fact that the connecting portion of the pre-selection element is engaged or not into the connecting seat of the sinker.

In one aspect, the needle comprises a shaft ending on top with a head configured for interacting with the yarns fed to the knitting machine.

In one aspect, the pre-selection element is positioned, in use, at least with its shaft and the actuating portion that are co-planar with the respective needle and so as to be radially beside the shaft of the needle and outside it with respect to the central axis.

In one aspect, the pre-selection element comprises an actuating butt configured for engaging, as a result of an ascending motion of the needle until the pre-selection element has reached said pre-selection configuration (in which the connecting portion is engaged into the connecting seat defined in the sinker), a pre-selection cam belonging to said control cams of the needle-holding cylinder.

In one aspect, said actuating butt is defined on said actuating portion of the pre-selection element.

In one aspect, the pre-selection cam is shaped so as to enable the engagement of the actuating butt of the pre-selection elements in certain angular sectors around the needle-holding cylinder only.

In one aspect, the pre-selection cam is configured for keeping engaged therewith the actuating butt of the pre-selection element also as a result of a descending motion of the respective needle inside the longitudinal groove, so as to support or keep the pre-selection element at a given vertical height corresponding to the pre-selection configuration, keeping the connecting portion of the pre-selection element engaged into the connecting seat of the sinker.

In one aspect, the mutual shape of the pre-selection cam and of the actuating butt of the pre-selection element creates a connection that allows:

- to keep or select the vertical height of the butt of the pre-selection element regardless of the position of the respective needle, said height being defined by the pre-selection cam; and
- to rotate/oscillate the pre-selection element with respect to the pre-selection cam around a pivot corresponding to a contacting point between the butt and the pre-selection cam, said rotation causing the connecting portion to approach or get away with respect to the respective needle.

In one aspect, the pre-selection element is configured for rotating/oscillating around said pivot when it is in said pre-selection configuration, as a result of the movement of the sinker inside the respective radial groove, approaching or away from the central axis of the needle-holding cylinder, the sinker acting upon the connecting portion engaged into the connecting seat.

In one aspect, said connection, obtained by means of the mutual shape of the pre-selection cam and of the actuating butt of the pre-selection element, allows:

- to keep the engagement of the actuating butt of the pre-selection element to the pre-selection cam regardless of the radial movement of the respective sinker;
- to keep the engagement of the connecting portion of the pre-selection element into the connecting seat of the sinker regardless of the radial movement of the respective sinker.

In one aspect, the engagement of the actuating butt of the pre-selection element to the pre-selection cam corresponds to the pre-selection configuration.

In one aspect, the pre-selection cam comprises one or more angular portions, defined around the needle-holding cylinder, in which the engagement or disengagement of the actuating butts of the pre-selection elements, rotating with the needle-holding cylinder, with respect to the pre-selection cam itself is allowed.

In one aspect, the pre-selection cam has a tip-like or wedge-like section and is shaped or defined, if present along its circumferential development around the needle-holding cylinder, at least in the angular sectors in which it is engaged by the actuating butts of the pre-selection elements, by means of an upper surface and a lower surface, forming between them an acute angle and having in common a profile developing circumferentially, with a curved shape, around the needle-holding member and facing the latter.

In one aspect, the actuating butt of the pre-selection element is basically counter-shaped, in section, to the shape of the pre-selection cam.

In one aspect, the actuating butt of the pre-selection cam has a V-shaped or dovetail-shaped section, so as to surround, when it is engaged to the pre-selection cam, an upper surface and a lower surface of the pre-selection cam defining a tip-shaped or wedge-shaped section.

In one aspect, the V-shaped section of the actuating butt of the pre-selection element has a bottom point designed to match the tip of the pre-selection cam, along the curved profile defined by the pre-selection cam itself.

In one aspect, the operating portion of the activation element preferably acts upon the connecting portion of the pre-selection element belonging to the same needle-sinker assembly, and this action is preferably a selective pushing action.

In one aspect, the activation element is shaped as a flat bar and comprises:

- a respective shaft, preferably lying in the same radial groove of the respective sinker;
- the aforesaid operating portion, preferably defined on a front end of said shaft (facing the central axis);
- a control portion, preferably defined on a rear end of said shaft (outer end with respect to the central axis) and comprising a control butt configured for engaging, in given angular sectors around the sinker-holding ring, an activation cam belonging to said control cams of the sinkers placed on the sinker cover.

In one aspect, the activation element is positioned, in use, on a plane on which the connecting portion of the pre-selection element is positioned.

Basically, in use the activation element and the connecting portion of the pre-selection element are both positioned vertically in the same plane.

In one aspect, the activation element is positioned, in use, at least with its shaft and the operating portion that are co-planar with the respective sinker and so as to be at least partially below the sinker body (with respect to the sinker cover).

In this case the activation element represent an under-sinker member.

In one aspect, the activation cam is shaped so as to enable the engagement of the control butt of the activation elements in certain angular sectors around the sinker-holding ring only.

In one aspect, the activation cam defines an insertion path with which the aforesaid control butt of the activation element is engaged so as to guide the movement thereof, inside the respective radial groove, approaching (or away from) the central axis in accordance with a law of insertion motion (differing from said law of basic motion).

In one aspect, said law of insertion motion causes a movement of each activation element, previously pre-selected by means of the respective pre-selection element, which makes the operating portion thereof push the connecting portion of the pre-selection element belonging to the same needle-sinker assembly so that the connecting portion moves towards the central axis and, being engaged into the connecting seat of the sinker, pushes in its turn the sinker into the radial groove towards the central axis, causing an insertion movement of the sinker and thus performing the aforesaid activation (selection) of the sinker.

In one aspect, the pushing action of the operating portion of the activation element upon the connecting portion of the pre-selection element causes the aforesaid insertion movement of the sinker, which differs from the aforesaid basic movement caused by the sinker cam.

In one aspect, the thrust by the operating portion of the activation element upon the connecting portion of the pre-selection element, as a result of the translation imparted to the activation element by the activation cam, may cause the oscillation of the pre-selection element around said pivot, approaching the central axis.

In one aspect, in the condition in which:

- the pre-selection element is in said pre-selection configuration;

the butt and the counter-butt of the sinker engage said sinker cam so as to execute said basic movement;

the sinker cam causes a backward movement of the sinker inside the respective radial groove, away from the central axis of the needle-holding cylinder;

the needle-sinker assembly is configured for performing the following actions:

the sinker, getting back as a result of the basic movement caused by the sinker cam, pushes with its connecting seat the connecting portion of the pre-selection element and makes it rotate/oscillate around said pivot away from the respective needle (i.e. getting back with respect to the central axis of the needle-holding cylinder);

the pre-selection element pushes in its turn the operating portion of the activation element making the activation element get back away from the central axis of the needle-holding cylinder;

this causing the activation element to be positioned in a loading configuration in which it is ready to execute the movement imparted by the activation cam.

In said loading configuration the sinker and the activation element are taken out with respect to the cylinder, i.e. they are away from the central axis.

In one aspect, starting from said loading configuration the activation element, as a result of the activation cam, moves approaching the central axis and pushes with its operating portion the connecting portion of the pre-selection element, which moves in its turn towards the central axis and pushes the sinker into the radial groove towards the central axis, executing said insertion movement of the sinker.

In one aspect, the activation element is configured for moving away from the central axis as a result of a thrust of the respective pre-selection element, and approaching the central axis as a result of the motion imparted by the activation cam.

In one aspect, the activation element is configured for not imparting any movement or thrust directly to the respective sinker (but only by means of the pre-selection element).

In one aspect, the activation element is configured for being pushed by or for pushing the respective pre-selection element only.

In one aspect, the pre-selection element (in particular the connecting portion thereof) is configured for:

executing a vertical/axial (preferably shifting) movement as a result of the ascending motion of the corresponding needle until the pre-selection configuration is reached; and executing a horizontal/radial (preferably oscillating) movement as a result of the translation of the corresponding sinker in the respective radial groove by means of the sinker cam or as a result of the thrust imparted by the corresponding activation element.

In one aspect, the functional portion of the sinker comprises an auxiliary plane designed, when the sinker executes the aforesaid insertion movement, to be positioned between two adjacent needles so as to receive one or more yarns resting thereon, hooked by the needles getting back into the longitudinal grooves of the needle-holding cylinder, for making a special stitch.

In one aspect, said auxiliary plane is a raised plane (i.e. vertically distanced in a direction parallel to the central axis) with respect to said basic plane, and said special stitch formed by the auxiliary plane is a terry stitch.

In one aspect, the elements constituting the needle-sinker assembly, i.e. the needle, the holding-down sinker, the pre-selection element and the activation element are made as flat, thin plates, with a greater length and width (or height) than the thickness.

In one aspect, the needle, the holding-down sinker, the pre-selection element and the activation element are flat elements, preferably metal elements.

In one aspect, the needle, the holding-down sinker, the pre-selection element and the activation element are elements obtained by cutting, stamping and/or bending flat bars.

In one aspect, the needle-holding cylinder comprises a first stopping member placed outside the longitudinal grooves and configured for stopping the ascending motion of the pre-selection elements at a first vertical height corresponding to the height at which the actuating butts of the pre-selection elements engage onto the pre-selection cam.

In one aspect, the first stopping member is located, along a direction parallel to the central axis (i.e. a vertical direction), above the actuating portions of the pre-selection elements.

In one aspect, the stopping action during the ascending motion of the pre-selection element occurs when the actuating portions abut against the first stopping member, which prevents the pre-selection element from ascending further.

In one aspect, the first stopping member is located, with respect to the needle-holding cylinder, so as to be radially placed between the needles (in particular the shafts of the needles) and the pre-selection elements (in particular the shafts of the pre-selection elements).

In one aspect, the first stopping member is a spring or a circular, thread-like element surrounding circumferentially the whole needle-holding cylinder.

In one aspect, the needle-holding cylinder comprises a second stopping member places outside the longitudinal grooves and configured for stopping the descending motion of the pre-selection elements at a second vertical height at which the connecting portions of the pre-selection elements do not engage the connecting seats of the sinker (i.e. the pre-selection elements are not in their pre-selection configuration and the actuating butts do not engage the pre-selection cam).

In one aspect, said second vertical height is smaller than said first vertical height.

In one aspect, the pre-selection elements comprise each a respective stopping butt configured for abutting, as a resulting a descent of the pre-selection element, against said second stopping member, thus preventing the pre-selection element from descending further.

In one aspect, the second stopping member is located, along a direction parallel to the central axis, below the stopping butts and above the actuating portions of the pre-selection elements.

In one aspect, the second stopping member is located, along a direction parallel to the central axis, above the first stopping member.

In one aspect, second first stopping member is located, with respect to the needle-holding cylinder, so as to be radially placed between the needles (in particular the shafts of the needles) and the pre-selection elements (in particular the shafts of the pre-selection elements).

In one aspect, the second stopping member is a spring or a circular, thread-like element surrounding circumferentially the whole needle-holding cylinder.

Basically, the vertical motion (stroke) of the pre-selection element is limited within the axial distance between the actuating portion and the stopping butt, which stop the ascending and descending motion against the first and second stopping member, respectively.

In one aspect, the machine comprises a plurality of yarn feeds, preferably one, more preferably two or four or eight thereof.

In an independent aspect thereof, the invention relates to a method for knitting in a circular knitting machine for knitwear, the method comprising the steps of:

arranging a circular textile machine comprising:

a needle-holding cylinder having a plurality of longitudinal grooves arranged around a central (vertical) axis of the needle-holding cylinder;

a plurality of needles, each being movably (slidingly) housed in a respective longitudinal groove and configured for moving in a controlled manner inside the longitudinal groove;

a sinker-holding ring placed near an upper end of the needle-holding cylinder and coaxial therewith, the sinker-holding ring having a plurality of radial grooves arranged around the central axis and, in use, being integral with the needle-holding cylinder;

a plurality of holding-down sinkers, each being movably (slidingly) housed, at least partially, in a respective radial groove and configured for moving in a controlled manner inside the radial groove; wherein the radial grooves are angularly offset with respect to the longitudinal grooves, so that a circumferential alternation of longitudinal grooves and radial grooves is present around the central axis, and wherein each needle is paired with at least one respective adjacent sinker thus forming a needle-sinker assembly, the machine globally comprising a plurality of needle-sinker assemblies;

arranging, for each needle-sinker assembly of said plurality of needle-sinker assemblies, or for each of the needle-sinker assemblies of a sub-set of needle-sinker assemblies:

a pre-selection element, paired or operatively associated with the respective needle and comprising a connecting portion configured for selectively cooperating with said at least one adjacent sinker belonging to the same needle-sinker assembly;

an activation element, paired or operatively associated with said pre-selection element and comprising an operating portion;

wherein the pre-selection element is shaped so that the connecting portion is aligned with the respective activation element;

performing a knitting operation by means of one or more of said needle-sinker assemblies for making stitches.

In one aspect, the step of performing a knitting operation comprises the steps of:

vertically moving, in a selective manner, the needle in the respective longitudinal groove until the pre-selection element is engaged;

vertically moving the pre-selection element, as a result of the ascending motion of the respective needle, to a pre-selection configuration in which said connecting portion is engaged into a connecting seat defined in the sinker belonging to the same needle-sinker assembly, thus causing a pre-selection of the sinker with the ascending motion of the corresponding needle;

horizontally moving the activation element towards said central axis, as far as an activation (selection) position in which the operating portion of the activation element acts upon the pre-selection element belonging to the same needle-sinker assembly;

by means of the connecting portion of the pre-selection element, upon which the operating portion of the activation element acts, moving the sinker in the radial groove towards the central axis, thus activating (selecting) the sinker itself.

In one aspect, in said step of moving the sinker in the radial groove, said activation of the sinker by the activation element causes the movement (insertion) of the sinker as far as given activation position in which the sinker executes a specific operation while knitting.

In one aspect, the step of vertically moving the needle includes engaging a butt of the needle, radially protruding from the corresponding longitudinal groove, into paths defined by needle cams belonging to control cams of the needle-holding cylinder, so that the needle axially moves with respect to the respective longitudinal groove according to a given law of motion.

In one aspect, the step of vertically moving the pre-selection element, as a result of the ascending motion of the respective needle, includes a step of getting in contact with and vertically pushing, by means of a pushing portion of the needle placed below the actuating portion of the pre-selection element, the pre-selection element until said pre-selection configuration is reached.

In one aspect, in the step of getting contact with and pushing the pushing portion exerts its thrust, from below and starting from a given vertical contact height reached by the needle during its ascending motion, upon a lower surface of the actuating portion of the pre-selection element, so that the ascent of the needle causes a corresponding ascent of the whole pre-selection element.

In one aspect, the step of arranging a knitting machine comprises arranging:

control cams of the needle-holding cylinder arranged around the needle-holding cylinder and movable with respect to said needle-holding cylinder around the central axis for causing or allowing the axial movement of the needles along the longitudinal grooves so as to enable stitch formation by said needles;

control cams of the sinkers arranged on a sinker cover, placed on the sinker-holding ring, and movable with respect to said sinker-holding ring around the central axis for causing or allowing the horizontal movement of the sinkers along the radial grooves so as to cooperated to enable stitch formation by said sinkers.

In one aspect, the step of performing a knitting operation comprises the step of engaging a butt of the sinker into a sinker path, defined by a sinker cam of the knitting machine, so as to guide the movement thereof, inside the respective radial groove, approaching or away from the central axis of the needle-holding cylinder according to a law of basic motion, so as to execute a basic movement.

In one aspect, said law of basic motion creates a step of cyclically moving the sinkers so as to lead a functional portion to be placed between two adjacent needles so that the yarn, or yarns, hooked by the needles cooperate with the functional portion of the sinker, while the needles get back into the longitudinal grooves of the needle-holding cylinder, so as to execute a basic knitted design.

In one aspect, in said step of performing a knitting operation, each sinker may execute said basic movement regardless of the fact that the corresponding pre-selection element is or not in said pre-selection configuration, i.e. regardless of the fact that the connecting portion of the pre-selection element is engaged or not into the connecting seat of the sinker.

In one aspect, in the step of vertically moving the pre-selection element, an actuating butt of the pre-selection element engages, as a result of an ascending motion of the needle until the pre-selection configuration is reached by the pre-selection element, a pre-selection cam belonging to the control cams of the needle-holding cylinder.

In one aspect, the pre-selection cam enables the engagement of the actuating butt of the pre-selection elements in certain angular sectors around the needle-holding cylinder only.

In one aspect, the step of performing a knitting operation, the pre-selection cam keeps engaged therewith the actuating butt of the pre-selection element also as a result of a descending motion of the respective needle inside the longitudinal groove, and supports the pre-selection element at a given vertical height corresponding to the pre-selection configuration, keeping the connecting portion of the pre-selection element engaged into the connecting seat of the sinker.

In one aspect, the step of performing a knitting operation includes:

keeping (or selecting) the vertical height of the butt of the pre-selection element regardless of the position of the respective needle, said height being defined by the pre-selection cam; and rotating/oscillating the pre-selection element with respect to the pre-selection cam around a pivot corresponding to a contacting point between the butt and the pre-selection cam, said rotation causing the connecting portion to approach or get away with respect to the respective needle.

In one aspect, in the step of performing a knitting operation, the pre-selection element rotates/oscillates around said pivot when it is in said pre-selection configuration, as a result of the movement of the sinker inside the respective radial groove, approaching or away from the central axis of the needle-holding cylinder, the sinker acting upon the connecting portion engaged into the connecting seat.

In one aspect, the step of performing a knitting operation comprises a step of engaging a control butt of a control portion of the activation element with an activation cam belonging to said control cams of the sinkers, in given angular sectors around the sinker-holding ring, the activation cam defining an insertion path with which the aforesaid control butt of the activation element gets engaged so as to guide the movement thereof approaching or away with the central axis in accordance with a law of insertion motion.

In one aspect, said law of insertion motion creates a step of moving the activation element so as to make the operating portion push the pre-selection element (belonging to the same needle-sinker assembly) so that the connecting portion thereof moves towards the central axis and, if the connecting portion is engaged into the connecting seat of the sinker, pushes the sinker into the radial groove towards the central axis, causing an insertion movement of the sinker and thus performing the aforesaid activation (selection) of the sinker.

In one aspect, the pushing action of the operating portion of the activation element upon the connecting portion of the pre-selection element causes the aforesaid insertion movement of the sinker and not the aforesaid basic movement caused by the sinker cam.

In an independent aspect thereof, the invention relates to a needle-sinker assembly for circular knitting machines for knitwear, comprising:

a needle, designed to be movably (slidingly) housed in a respective longitudinal groove of a needle-holding cylinder of a circular knitting machine having a central axis, and configured for moving in a controlled manner inside the longitudinal groove;

at least one holding-down sinker, designed to be movably (slidingly) housed, at least partially, in a respective radial groove of a sinker-holding ring of the knitting machine placed near an upper end of the needle-holding cylinder and coaxial therewith, said at least one holding-down sinker being configured for moving in a controlled manner inside the radial groove and being preferably provided, on a lower side thereof, with a connecting seat;

a pre-selection element, designed to be paired or operatively associated with the respective needle and comprising a connecting portion configured for selectively cooperating with said at least one adjacent sinker belonging to the same needle-sinker assembly;

an activation element, designed to be paired or operatively associated with said pre-selection element and comprising an operating portion;

wherein the pre-selection element is shaped so that the connecting portion is aligned with the respective activation element.

In one aspect, concerning said assembly:

the pre-selection element is configured for being vertically movable, as a result of an ascending motion of said needle, to a pre-selection configuration in which said connecting portion may be engaged into said connecting seat of said at least one sinker, thus causing a pre-selection of the sinker with the ascending motion of the corresponding needle;

the activation element is configured for being horizontally movable, towards said central axis, as far as an activation (or selection) position in which the operating portion of the activation element acts upon the pre-selection element, so that the connecting portion of the pre-selection element, when (and if) engaged into the connecting seat of the sinker, causes in its turn a movement of the sinker in the radial groove towards the central axis, thus performing an activation (or selection) of the sinker.

In an independent aspect thereof, the present invention also relates to a knitting method, for manufacturing knitted fabric, which can be implemented by means of a machine according to one or more of the preceding aspects.

In an independent aspect thereof, the present invention also relates to a use, in a knitting machine, of a needle-sinker assembly according to one or more of the preceding aspects, for manufacturing knitted stitches.

In a further independent aspect thereof, the invention relates to a circular knitting machine for knitwear, comprising:

a needle-holding cylinder having a plurality of longitudinal grooves arranged around a central axis of the needle-holding cylinder;

a plurality of needles, each being movably housed in a respective longitudinal groove and configured for moving in a controlled manner inside the longitudinal groove;

a sinker-holding ring placed near an upper end of the needle-holding cylinder and coaxial therewith, the sinker-holding ring having a plurality of radial grooves arranged around the central axis and, in use, being integral with the needle-holding cylinder;

a plurality of holding-down sinkers, each being movably housed, at least partially, in a respective radial groove and configured for moving in a controlled manner inside the radial groove.

In one aspect, the radial grooves are angularly offset with respect to the longitudinal grooves, so that a circumferential alternation of longitudinal grooves and radial grooves is present around the central axis, and wherein each needle is paired with at least one respective adjacent sinker thus forming a needle-sinker assembly, the knitting machine globally comprising a plurality of needle-sinker assemblies.

In one aspect, the knitting machine comprises, for each needle-sinker assembly of said plurality of needle-sinker assemblies, or for each of the needle-sinker assemblies of a sub-set of needle-sinker assemblies:

a pre-selection element, paired or operatively associated with the respective needle and comprising a connecting portion configured for selectively cooperating, either directly or indirectly, with said at least one adjacent sinker belonging to the same needle-sinker assembly.

In one aspect, the connecting portion, in use, is aligned with the radial groove housing said at least one adjacent sinker belonging to the same needle-sinker assembly.

In one aspect, each radial groove has a rear section and a front section, the front section developing in a continuous manner from said rear section and being open on the front side towards said central axis.

In one aspect, the front section is wider than the rear section.

In one aspect, the front section is configured for laterally containing, at least partially, and guiding (at least) the connecting portion of the pre-selection element in its movements during the operating cycle of the knitting machine.

In one aspect, the pre-selection element is movably housed, at least partially, in the same longitudinal groove of the respective needle.

In one aspect, the connecting portion laterally rises from the longitudinal groove so as to be aligned with the radial groove housing said at least one adjacent sinker.

In one aspect, the radial groove comprises a first cut defining said rear section and a second cut defining said front section.

In one aspect, the rear section has a first width and the front section has a second width.

In one aspect, the front section has a greater development in width than said rear section, on both sides with respect to a median lying plane of the rear section.

In one aspect, the rear section of the radial groove is defined between two side walls of the rear portion itself, facing each other and separated of an amount corresponding to said first width.

In one aspect, the front section of the radial groove is defined between two lateral faces of the front portion itself, facing each other and separated of an amount corresponding to said second width.

In one aspect, the two lateral faces of the front section are laterally distanced with respect to the two side walls of the rear section, so that the radial groove widens from the rear section to the front section.

In one aspect, the two side walls of the rear section are vertical and parallel to one another. In one aspect, the two lateral faces of the front section are vertical and parallel to one another. In one aspect, the first width corresponds to the distance between the two side walls of the rear section. In one aspect, the second width corresponds to the distance between the two lateral faces of the front section.

In one aspect, the rear section is configured for movably retaining and guiding, at least partially, the respective sinker in its translation movements, approaching or away from the central axis, during the operating cycle of the knitting machine.

In one aspect, the knitting machine comprises, for each needle-sinker assembly of said plurality of needle-sinker assemblies, or for each of the needle-sinker assemblies of a sub-set of needle-sinker assemblies:

an activation element, paired or operatively associated with said pre-selection element and comprising an operating portion;

and wherein the activation element is movably housed, at least partially, in the same radial groove housing said at least one adjacent sinker belonging to the same needle-sinker assembly.

In one aspect, the rear section is configured for movably retaining and guiding, at least partially, the respective activation element in its translation movements, approaching or away from the central axis, during the operating cycle of the knitting machine.

In one aspect, the radial groove, and in particular the rear section, movably houses the respective sinker and the respective activation element, the latter being placed, at least partially, slidingly below the sinker.

In one aspect, the operating portion of the activation element protrudes in the front part from the rear portion of the radial groove so as to be placed, in at least one operating condition of the knitting machine, between the two lateral faces of the front section.

In one aspect, the sinker protrudes in the front part from the rear portion of the radial groove so as to be placed, with at least a part of its body, between the two lateral faces of the front section.

In one aspect, the operating portion of the activation element and part of the front end of the sinker are movably housed, at least partially and under certain operating conditions of the knitting machine, in the space defined by the front section of the radial groove (which can be identified between the two lateral faces).

In one aspect, the first width and the second width are defined or calculated in a direction tangent to a circumferential development of the sinker-holding ring (around the central axis).

In one aspect, the first width (of the rear section) basically corresponds to the thickness of the sinker housed in the radial groove.

In one aspect, the first width (of the rear section) basically corresponds to the thickness of the activation element.

In one aspect, the second width (of the front section) basically corresponds to the thickness of the connecting portion of the pre-selection element.

In one aspect, said first cut is made horizontally and on the whole radial length of the radial groove, whereas said second cut is made vertically and crosses, i.e. overlaps, said first cut so as to widen it and thus define the front section having the second width, differing from the rear portion having the first width.

In one aspect, said first cut has a thickness corresponding to said first width and said second cut has a thickness corresponding to said second width.

In one aspect, the two side walls of the rear section end above with a respective upper free edge and below on a bottom surface of the radial groove.

In one aspect, the two lateral faces of the front section end above with a respective upper free edge and below with a respective lower free edge.

In one aspect, the two upper edges of the two lateral faces of the front section are longer, in a radial direction, with respect to the two lower edges.

In one aspect, said second cut, defining the front section with respect to the rear section, is vertically inclined so that the front section has a greater radial extension in its upper end than the radial extension of its lower end.

In one aspect, said second cut, which is made by crossing said first cut, forms two connecting steps between the front section and the rear section, on which the thickness of the radial groove goes from said first width to said second width, and vice versa.

In one aspect, each connecting step extends from the respective upper edge to the respective lower edge of the lateral face of the front section.

In one aspect, said second cut, vertically inclined, forms said two connecting steps having an inclined or curved configuration.

In one aspect, said connecting steps approach the central axis getting from the upper edges (94) of the two lateral faces to the two lower edges of the two lateral faces.

In one aspect, each pair of adjacent radial grooves defines therebetween a respective slat or wall dividing them.

Each slat is shared by two adjacent radial grooves and thus by two adjacent rear and front sections.

Similarly, the front section of each radial groove is defined between two adjacent slats, wherein a lateral face belongs to a right slat and the other lateral face belongs to a left slat.

Similarly, the rear section of each radial groove is defined between two adjacent slats, wherein a side wall belongs to a right slat and the other side wall belongs to a left slat.

Each slat, due to the presence of the rear and front portion defined by the first and second cut, exhibits two portions with different thicknesses:

- a first portion defining the rear thickness of the slat, obtained between the rear sections of two adjacent radial grooves;
- a second portion defining the front thickness of the slat, obtained between the front sections of two adjacent radial grooves;
- wherein the front thickness is smaller than the rear thickness (since the second width is smaller than the first width).

In one aspect:

- the pre-selection element is shaped so that the connecting portion is aligned with the respective activation element;
- the pre-selection element is vertically movable, as a result of an ascending motion of the respective needle, to a pre-selection configuration in which said connecting portion is engaged into a connecting seat defined in the sinker belonging to the same needle-sinker assembly, thus causing a pre-selection of the sinker with the ascending motion of the corresponding needle;
- the activation element is horizontally movable, towards said central axis, until acting upon the pre-selection element belonging to the same needle-sinker assembly, so that the connecting portion of the pre-selection element, when engaged into the connecting seat of the sinker, causes in its turn a movement of the sinker in the radial groove towards the central axis, thus performing an activation of the sinker.

In one aspect, said activation of the sinker by the activation element causes an insertion movement of the sinker as far as given activation position in which the sinker executes a specific operation while knitting.

Further characteristics and advantages shall be more evident from the detailed description of a preferred embodiment of a circular knitting machine for knitwear, of a knitting method and of a needle-sinker assembly for circular knitting machines, according to the present invention.

DESCRIPTION OF THE DRAWINGS

This description shall be made below with reference to the accompanying drawings, provided to a merely indicative and therefore non-limiting purpose, in which:

FIG. 13 shows a sectioned, perspective view (from above) of a sinker-holding ring of a circular knitting machine for knitwear according to an aspect of the present invention, in accordance with a possible embodiment and some parts being removed; FIG. 13 shows in particular a sinker-holding ring as shown in FIG. 12 inside a knitting head; the embodiment of the present invention shown in FIG. 13 an be inserted into a knitting machine as in FIG. 12, also in accordance with an aspect of the present invention; it should be noticed that the section of FIG. 13 is made on a radial (vertical) plane getting through the central axis;

FIG. 14 shows a further sectioned, perspective view (from below) of the sinker-holding ring of FIG. 13;

DETAILED DESCRIPTION

Figure 12:
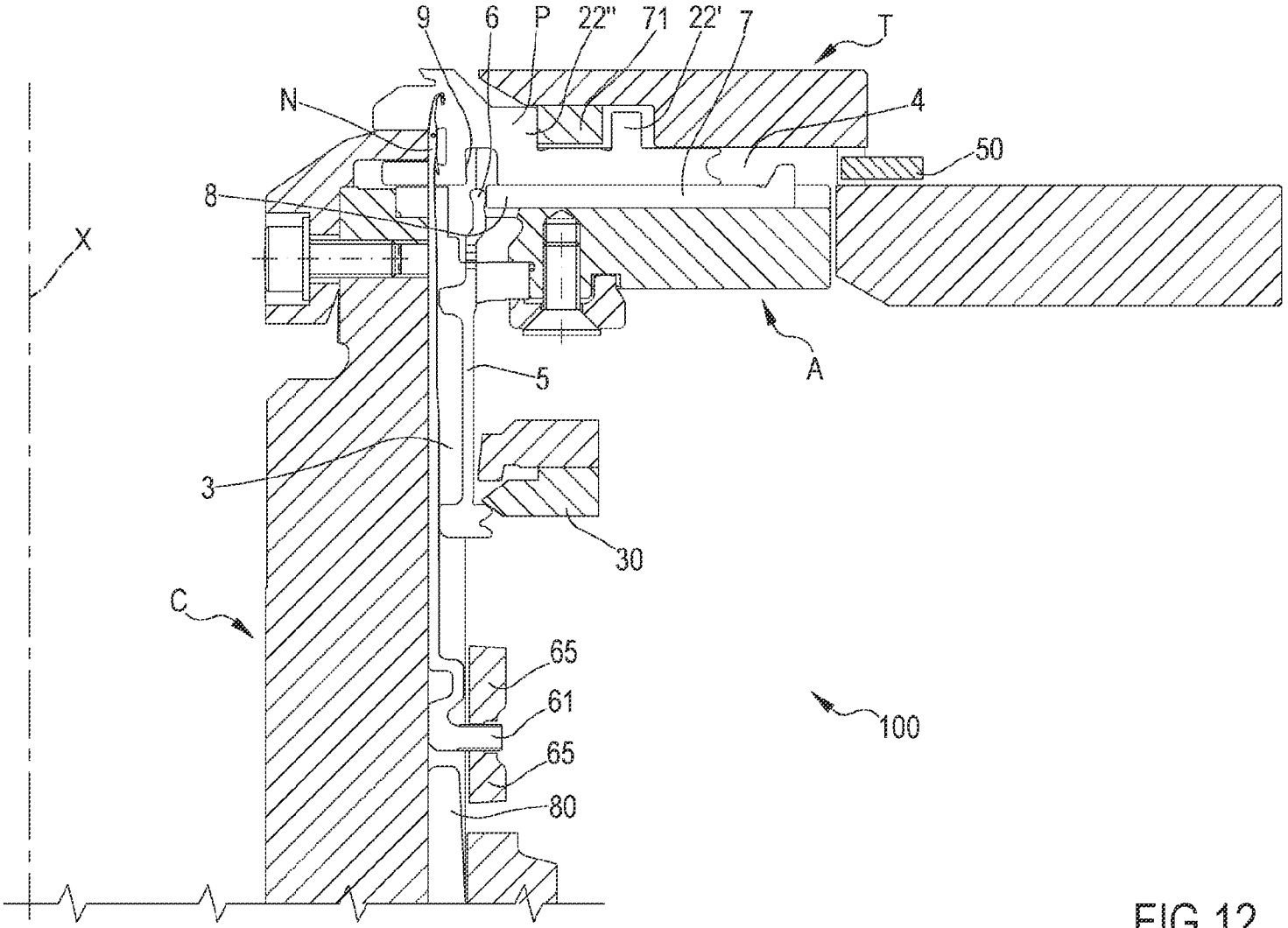
FIG. 12 shows a sectioned view of a portion of a circular knitting machine for knitwear according to the present invention, in accordance with a possible embodiment, some parts being removes; it should be noticed that FIG. 12 shows the elements of FIG. 1 placed in the knitting head, of which the needle-holding cylinder, the sinker-holding ring, the sinker cover, some control cams of the needle-holding cylinder and some control cams of the sinkers can be seen.
Figure 15:
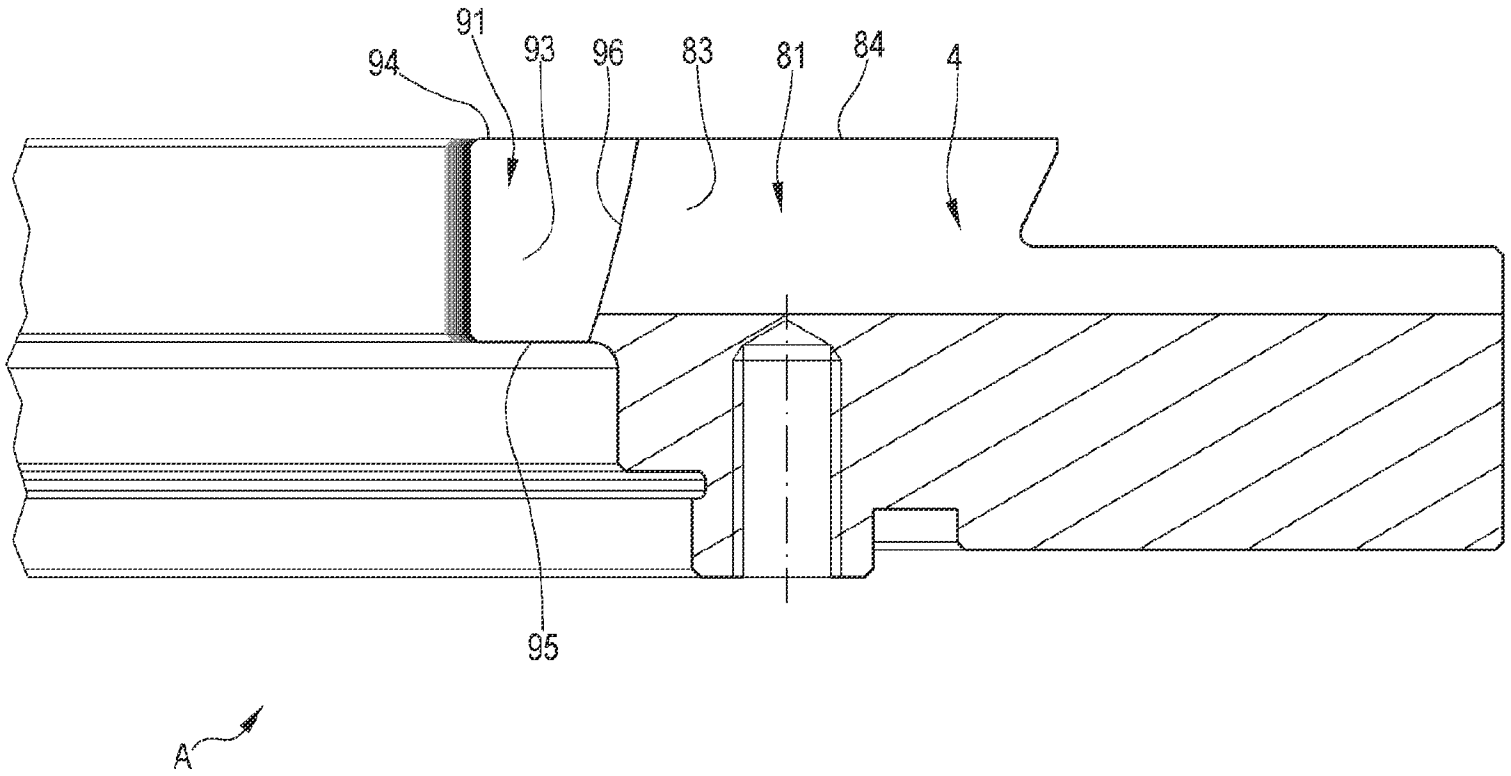
FIG. 15 shows a further sectioned, partial view of the sinker-holding ring of FIG. 13; this section is made on a radial (vertical) plane getting through the central axis.
Figure 17:
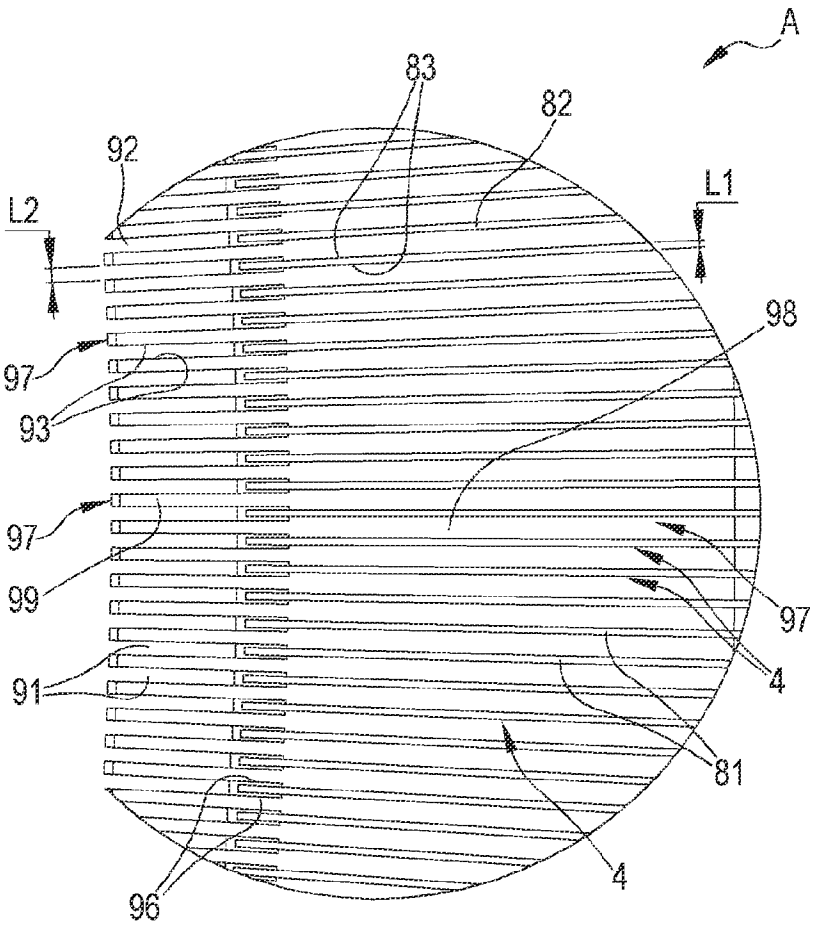
FIG. 17 shows a magnified view (detail) of a portion of FIG. 16.
Figure 16:
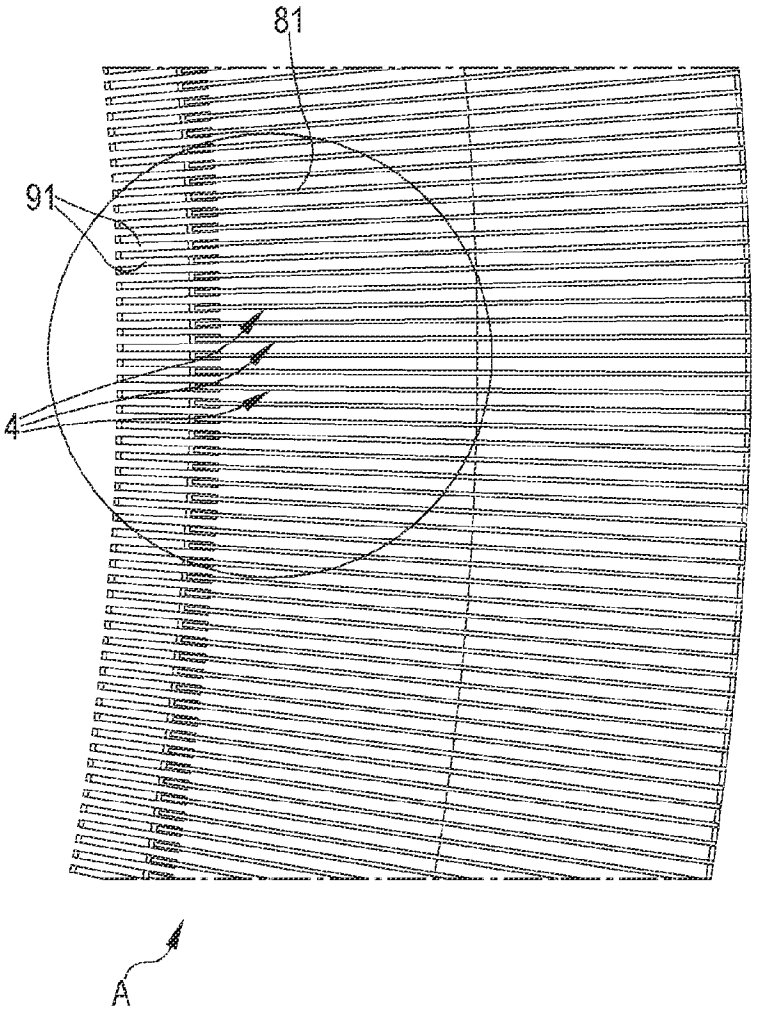
FIG. 16 shows a plan view, from above, of a portion of the sinker-holding ring of FIG. 13.

With reference to the figures mentioned, and in particular to FIG. 12, the numeral 100 globally designates a portion of a knitting head of a circular knitting machine for knitwear according to the present invention. The circular knitting machine for knitwear as shown is preferably a "seamless" machine. The circular knitting machine comprises a basement, not shown since it is of known type, constituting the supporting structure of the machine, and said knitting head 100 is mounted onto the basement.

The knitting head 100 comprises a needle-holding cylinder C having a plurality of longitudinal grooves 3 arranged around a central axis X of the needle-holding cylinder, and a plurality of needles N, each movably (in particular slidingly) housed in a respective longitudinal groove and configured for moving in a controlled manner inside the longitudinal groove. The needle-holding cylinder C is usually mounted in vertical position onto the basement, with the needles N arranged vertically and protruding beyond an upper edge of the needle-holding cylinder C.

The knitting head 100 comprises a sinker-holding ring A, placed near an upper end of the needle-holding cylinder C and coaxial therewith, having a plurality of radial grooves 4 arranged around the central axis X. The sinker-holding ring A is integral, with the knitting machine in use, with the needle-holding cylinder C. The sinker-holding ring A comprises a plurality of holding-down sinkers P, each movably (in particular slidingly) housed, at least partially, in a respective radial groove and configured for moving in a controlled manner inside the radial groove.

The knitting head 100 of the knitting machine further comprises:

- control cams of the needle-holding cylinder arranged around the needle-holding cylinder C and movable with respect to the latter around the central axis X for causing or allowing the axial movement of the needles N along the longitudinal grooves 3 so as to enable stitch formation by the needles;
- control cams of the sinkers arranged on a sinker cover T placed on the sinker-holding ring A, and movable with respect to the sinker-holding ring A around the central axis X for causing or allowing the horizontal movement of the sinkers along the radial grooves 4 so as to cooperated to enable stitch formation by the sinkers.

With the knitting machine in use, in accordance with the typical operating modes known in the field, the needle-holding cylinder C and the sinker-holding ring A, integral with one another, both rotate around the central axis X, whereas the control cams of the needle-holding cylinder and the control cams of the sinker-holding ring are stationary with respect to the needle-holding cylinder and to the sinker-holding ring (typically they are integral with the frame of the knitting machine). Thus a relative rotational motion between needles N and sinkers P and the respective control cams is generated, so as to turn the rotational motion of the needle-holding cylinder C into an axial motion of the needles N and the rotational motion of the sinker-holding ring A into a radial motion of the sinkers P, so as to allow needles and sinkers to form knitted fabric.

Preferably, the radial grooves 4 of the sinker-holding ring A are open on a radially inner edge of the ring itself, i.e. towards the central axis X. The sinker-holding ring A is moved in rotation around the central axis X together with the needle-holding cylinder C (since it is integral therewith), e.g. by means of the same motor.

However, the present invention may also be used on knitting machines operating in various modes, i.e. with stationary cylinder and ring and rotating control cams.

Preferably, as known per se, the longitudinal grooves 3 are obtained on a radially outer surface of the needle-holding cylinder C, and are arranged around the central axis X developing parallel to the latter. Each longitudinal groove houses a respective needle N and a respective drive chain (comprising a set of lat parts such as under-needle elements, selectors, etc.). The control cams of the cylinder are arranged as a casing around the cylinder C itself and lie facing the radially outer surface of the cylinder and thus the longitudinal grooves and the drive chains. These control cams are defined e.g. by plates and/or grooves arranged on an inner surface of the casing.

Suitable devices, not shown, feed the yarns to be knitted on one or more yarn feeding points (known as knitting feeds) usually arranged above the needle-holding cylinder C.

In the knitting machine of the present invention, the radial grooves 4 are angularly offset with respect to the longitudinal grooves 3, so that a circumferential alternation of longitudinal grooves and radial grooves is present around the central axis X, and wherein each needle N is paired with at least one respective adjacent sinker P thus forming a "needle-sinker assembly" (globally referred to with the numeral 1), the knitting machine globally comprises a plurality of needle-sinker assemblies 1.

It should be noticed that FIGS. 1-8 and 12 show a sectioned view made on a radial (vertical) plane getting through the central axis X and on which the needle N lies, but at the same time a rear plane on which the sinker P lies can also be seen.

The knitting machine comprises, for each needle-sinker assembly 1, or for the needle-sinker assemblies belonging to a sub-set of needle-sinker assemblies, additional elements:

- a pre-selection element 5, paired or operatively associated with the respective needle N and comprising a connecting portion 6 configured for selectively cooperating, either directly or indirectly, with an adjacent sinker P belonging to the same needle-sinker assembly;
- an activation element 7, paired or operatively associated with the pre-selection element 5 and comprising an operating portion 8.

Inside the needle-sinker assembly 1:

- the pre-selection element 5 is vertically movable, as a result of an ascending motion of the respective needle N, to a pre-selection configuration (FIGS. 4-8, shown in detail below) in which said connecting portion 6 is engaged into a connecting seat 9 defined in the sinker P belonging to the same needle-sinker assembly, thus causing a pre-selection of the sinker P with the ascending motion of the corresponding needle N;
- the activation element 7 is horizontally movable, towards the central axis X, as far as an activation (or selection) position in which the operating portion 8 of the activation element 7 acts upon (preferably pushes against) the pre-selection element 5 belonging to the same needle-sinker assembly 1, so that the connecting portion 6 of the pre-selection element 5, when engaged into the connecting seat 9 of the sinker, causes in its turn a movement of the sinker P in the radial groove 4 towards the central axis X, thus performing an activation (or selection) of the sinker.

Preferably, as in the embodiment shown by way of example in the figures, the pre-selection element 5 is shaped so that the connecting portion 6 is aligned with the respective activation element 7.

The wording "sub-set" of the aforesaid needle-sinker assemblies 1 refers to a group or a selection of needle-sinker assemblies 1 within the plurality of needle-sinker assemblies of the knitting machine. For instance, the sub-set of needle-sinker assemblies 1 can be made up of the assemblies of a given sector of the needle-holding cylinder C and of the sinker-holding ring A, or by an alternation of needle-sinker assemblies (one every two assemblies) around the circumference of the cylinder and of the ring. In these cases the "sub-set" comprises all of the needle-sinker assemblies 1 provided with a pre-selection element 5 and with an activation element 7.

The wording "the radial grooves are angularly offset with respect to the longitudinal grooves" means that, by going around the knitting machine along the central axis X (i.e. looking at the machine in a plan view), an alternation of longitudinal grooves 3 and radial grooves 4 can be seen, in which each longitudinal groove is placed between two adjacent radial grooves and vice versa.

The fact that the connecting portion 6 is "aligned" with the respective activation element 7 means that at least the connecting portion 6 of the pre-selection element 5 and the operating portion 8 of the activation element 7 are basically co-planar and operate one beside the other (and in mutual contact) on the same vertical and radial plane (getting through the central axis).

It should be noticed that, in general, in the present invention and in the appended claims, where needle, sinker, pre-selection element, activation element, etc. and the respective actions and mutual interactions are mentioned, we are typically considering, if not otherwise indicated, elements belonging to the same needle-sinker assembly 1.

As can be seen in FIG. 12, preferably the pre-selection element 5 is movably housed, at least partially, in the same longitudinal groove 3 as the respective needle N.

Figure 11:
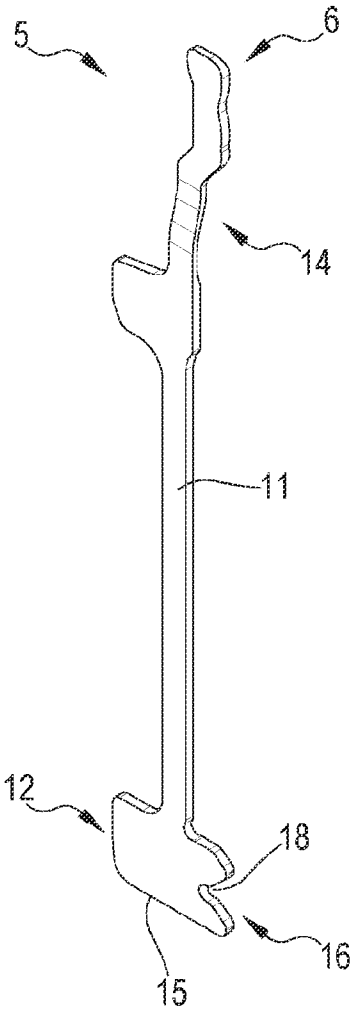
FIG. 11 is an exemplary perspective of the pre-selection element of FIG. 9.
Figure 10:
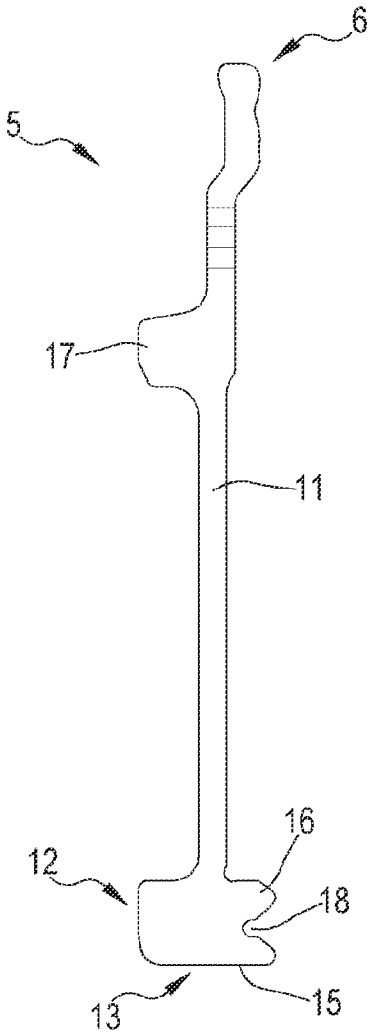
FIG. 10 is a side view of the pre-selection element of FIG. 9.

Preferably, the connecting portion 6 laterally rises from the longitudinal groove 3 so as to be co-planar with the radial groove 4 housing the adjacent sinker P belonging to the same needle-sinker assembly 1. The word "co-planar" means lying in the same plane or in general lying basically on the same section made on a radial (vertical) plane getting through the central axis X, at least in an operating condition. Furthermore, the word "co-planar" means that the connecting portion 6 of the pre-selection element 5 may be positioned at least partially in the same radial plane on which the connecting seat 9 defined in the sinker P lies. Basically, the activation element 5 is first paired with a respective needle N, and thus with a respective longitudinal groove 3, but its connecting portion 6 is designed to cooperate with the sinker P, and in particular with the connecting seat 9 of the sinker: therefore, at least the connecting portion 6 pf the pre-selection element gets out of the longitudinal groove 3 to reach the connecting seat 9. It should be noticed that in FIGS. 1-8 and 12 the pre-selection element 5 appears plane but actually its shaft is basically co-planar with the longitudinal groove 3 (preferably it is housed therein), whereas the connecting portion 6 basically lies on the plane of the sinker P lying behind (as explained above, the figures show the elements present on both planes). An exemplary structure of the pre-selection element 5 enabling this is shown in FIGS. 9-11. Basically, in FIGS. 1-8 and 12 the needle N lies on a plane (the plane of the sheet), whereas the respective sinker P lies on an offset plane, which is behind the plane of the needle.

It should be noticed that "connecting portion" 6 of the pre-selection element 5 refers to a portion which is able to create, selectively, an engagement, insertion, link or connection, in particular with the connecting seat suitably defined in the sinker.

Preferably, the activation element 7 is movably housed, at least partially, in the same radial groove 4 housing the adjacent sinker P belonging to the same needle-sinker assembly 1.

"Vertically movable" basically means axially movable, i.e. in a direction in accordance with the central axis X (i.e. ascending or descending). "Horizontally movable" basically means radially movable, i.e. in a radial direction approaching or away from the central axis X.

Preferably, the aforesaid activation of the sinker P by the activation element 7 causes the movement (or "insertion") of the sinker P as far as given activation position in which the sinker executes a specific operation while knitting.

"Alternation" of longitudinal and radial grooves means that each longitudinal groove 3 is included circumferentially (in plan view) between two adjacent radial grooves 4 and, similarly, each radial groove 4 is included circumferentially between two adjacent longitudinal grooves 3.

As shown by way of example in the figures, each needle N is provided with a butt 61 radially protruding from the corresponding longitudinal groove 3 and to be engaged into paths defined by needle cams 65 belonging to the aforesaid control cams of the needle-holding cylinder C, so that the needle can axially move with respect to the respective longitudinal groove 3 according to a given law of motion. Typically, the aforesaid ascending movement of the needle N is determined by the shape of said paths defined by the needle cams 65.

Let us now observe in particular FIGS. 9-11, which show an exemplary embodiment of the pre-selection element 5.

Preferably, the pre-selection element 5 is shaped as a flat bar and comprises:

- a shaft 11;
- the aforesaid connecting portion 6, preferably developing from an upper end of the shaft and to be positioned, at least partially, on the same lying plane of the radial groove 4 housing the adjacent sinker P belonging to the same needle-sinker assembly 1;
- an actuating portion 12, lying in the same longitudinal groove 3 of the respective needle N and preferably defined on a lower end 13 of the shaft 11; the actuating portion is configured for interacting with the respective needle N during its ascending motion.

Preferably, the connecting portion 6 is bent/inclined with respect to the shaft 11, thus being laterally offset with respect to the shaft itself, so that the shaft lies on a respective plane while the connecting portion lies (at least partially) on a different plane, laterally distanced with respect to the plane on which the shaft lies (as can be seen in FIG. 9).

The wording "laterally offset" means that the connecting portion 6 is inclined, bent, not aligned or curved laterally with respect to the shaft 11 of the pre-selection element 5.

Preferably, the pre-selection element 5 is wholly made as one piece.

The pre-selection element 5 may exhibit in all its parts a basically constant thickness. As an alternative, the connection portion 6 of the pre-selection element may have a greater thickness than the shaft 11. Preferably, the pre-selection element 5 has a junction portion 14 placed between the shaft 11 and the connecting portion 6, on which a bend causing the lateral offset of the connecting portion with respect to the shaft is defined.

Preferably, as can be seen in FIGS. 9 and 11, the shaft 11, the connecting portion 6 and the actuating portion 12 have a first, basically constant, thickness, whereas the junction portion 14 between the shaft and the connecting portion has a second thickness which is smaller than the first thickness.

Preferably, the shaft 11, the connecting portion 6 and the actuating portion 12 are integral with each other and mutually positioned in a stationary manner.

Preferably, with the assembly mounted, the shaft 11 of the pre-selection element 5 lies in the same longitudinal groove 3 as the respective needle N.

Preferably, with the assembly mounted, the connecting portion 6 lies in the same plane as the radial groove 4 housing the adjacent sinker P belonging to the same needle-sinker assembly 1.

Preferably, the needle N comprises a pushing portion 62 placed, with the needle-sinker assembly 1 positioned in the knitting machine, below the actuating portion 12 of the pre-selection element 5; the pushing portion 62 is configured for getting in contact, from below and at a given vertical contact height reached by the needle N during its ascending motion, with a lower surface 15 of the actuating portion 12 of the pre-selection element 5, so that a following and further ascending motion of the needle N causes a corresponding ascending motion of the whole pre-selection element 5 until reaching the aforesaid pre-selection configuration. Preferably, the pushing portion 62 is made as a bend, or "meander", in the structure of the needle shaft; the pushing portion 62 defines an abutment surface on which the lower surface 15 of the pre-selection element 5 abuts when the needle N ascends vertically. During the ascending motion of the needle N, this abutment surface pushes against the lower surface of the pre-selection element 5 and moves it upwards.

Preferably, the sinker P comprises an elongated-plate body 21 having:

- in an intermediate area of its development, a butt 22' and a counter-butt 22" both developing transversally on one side of the body;
- at a front end of the body 21, a functional portion 23 configured for interacting with the yarns fed to the knitting machine;
- the aforesaid connecting seat 9 made as a recess preferably on the side of the body opposed with respect to the butt 22' and to the counter-butt 22".

The recess is configured for receiving the connecting portion 6 of the pre-selection element 5 inserted therein, when the latter reaches the pre-selection configuration.

Preferably, the recess is defined in the lower part of the sinker P, facing the connecting portion 6 of the pre-selection element 5.

Preferably, the butt 22' and the counter-butt 22" are defined in the upper part of the sinker.

Preferably, the plate P is made completely as one piece.

Preferably, the sinker P has in all its parts a basically constant thickness.

Preferably, the control cams of the sinkers, arranged on the sinker cover T, comprise a sinker cam 71 defining a sinker path in which the aforesaid butt 22' and/or the aforesaid counter-butt 22" of the sinker P engage so as to guide the movement thereof, inside the respective radial groove 4, approaching or away from the central axis X of the needle-holding cylinder C according to a law of basic motion, so as to execute a "basic movement".

Preferably, the cam 71 moves the sinker P radially towards the central axis X (i.e. it "inserts it") pushing against the counter-butt 22", and moves the sinker P radially away from the central axis X (i.e. it "takes it out") acting upon the butt 22'.

Preferably, this law of basic motion causes a cyclical movement of the sinkers P leading the functional portion 23 to be placed between two adjacent needles N so that the yarn, or yarns, hooked by the needles cooperate with the functional portion of the sinker, while the needles N get back into the longitudinal grooves 3 of the needle-holding cylinder C, so as to execute a basic knitted design.

Preferably, this basic knitted design corresponds to the formation of plain knitted loops.

Preferably, the functional portion 23 of the sinker comprises a basic plane 24 designed, when the butt 22' and the counter-butt 22" engage the cam path defining the law of basic motion, to be placed between two adjacent needles N so as to receive the yarn, or yarns, resting thereon, hooked by the needles getting back into the longitudinal grooves of the needle-holding cylinder, for making plain stitches.

Preferably, the basic plane 24 of the sinker P is a "knitting plane", i.e. the plane in which the yarn, or yarns, is placed during stitch formation.

Preferably, each sinker P is configured for executing the aforesaid basic movement regardless of the fact that the corresponding pre-selection element 5 is or not in the pre-selection configuration, i.e. regardless of the fact that the connecting portion 6 of the pre-selection element 5 is engaged or not into the connecting seat 9 of the sinker P.

Preferably, the needle N comprises a shaft 63 ending on top with a head 64 configured for interacting with the yarns fed to the knitting machine.

Preferably, the pre-selection element 5 is positioned, in use, at least with its shaft 11 and the actuating portion 12 that are co-planar with the respective needle N and so as to be radially beside the shaft 63 of the needle N and outside it with respect to the central axis X.

Preferably, the pre-selection element 5 comprises an actuating butt 16 configured for engaging, as a result of an ascending motion of the needle N until the pre-selection element 5 has reached said pre-selection configuration (in which the connecting portion 6 is engaged into the connecting seat 9 defined in the sinker P), a pre-selection cam 30 belonging to the control cams of the needle-holding cylinder.

Preferably, the pre-selection cam 30 is located around the needle-holding cylinder (i.e. it faces it outside).

Preferably, the actuating butt 16 is defined on the actuating portion 12 of the pre-selection element 5.

Preferably, the pre-selection cam 30 is shaped so as to enable the engagement of the actuating butt 16 of the pre-selection elements 5 in certain angular sectors around the needle-holding cylinder C only.

Preferably, the pre-selection cam 30 is configured for keeping engaged therewith the actuating butt 16 of the pre-selection element 5 also as a result of a descending motion of the respective needle N inside the longitudinal groove 3, so as to keep the pre-selection element 5 at a given vertical height corresponding to the pre-selection configuration, keeping the connecting portion 6 of the pre-selection element 5 engaged into the connecting seat 9 of the sinker P.

Preferably, the mutual shape of the pre-selection cam 30 and of the actuating butt 16 of the pre-selection element 5 creates a connection that allows at the same time:

- to keep (and/or possibly select) the vertical height of the butt 16 of the pre-selection element 5 regardless of the position of the respective needle N, this height being defined by the pre-selection cam 30; and
- to rotate/oscillate the pre-selection element 5 with respect to the pre-selection cam 30 around a pivot 18 corresponding to a contacting point between the actuating butt 16 and the pre-selection cam 30, this rotation/oscillation causing the connecting portion 6 to approach or get away with respect to the respective needle N.

Preferably, the pre-selection element 5 is configured for rotating/oscillating around said pivot 18 when it is in the pre-selection configuration, as a result of the movement of the respective sinker P inside the respective radial groove 4, approaching or away from the central axis X of the needle-holding cylinder C, the sinker P acting upon the connecting portion 6 engaged into the connecting seat 9.

Preferably, the aforesaid connection, obtained by means of the mutual shape of the pre-selection cam 30 and of the actuating butt 16 of the pre-selection element 5, allows:

- to keep the engagement of the actuating butt 16 of the pre-selection element 5 to the pre-selection cam 30 regardless of the radial movement of the respective sinker P;
- to keep the engagement of the connecting portion 6 of the pre-selection element 5 into the connecting seat 9 of the sinker P regardless of the radial movement of the respective sinker.

Preferably, the engagement of the actuating butt 16 of the pre-selection element 5 to the pre-selection cam 30 corresponds to said pre-selection configuration.

Preferably, the pre-selection cam 30 comprises one or more angular portions, defined around the needle-holding cylinder C, in which the engagement or disengagement of the actuating butts 16 of the pre-selection elements 5, rotating with the needle-holding cylinder C, from the pre-selection cam 30 itself is allowed.

Preferably, the pre-selection cam 30 has a tip-like or wedge-like section and is shaped or defined, if present along its circumferential development around the needle-holding cylinder C, at least in the angular sectors in which it is engaged by the actuating butts 16 of the pre-selection elements 5, by means of an upper surface 31 and a lower surface 32, forming between them an acute angle and having in common a profile developing circumferentially, with a curved shape, around the needle-holding member C and facing the latter.

Preferably, the actuating butt 16 of the pre-selection element 5 is basically counter-shaped, in section, to the shape of the pre-selection cam 30.

Preferably, as shown by example in the figures, the actuating butt 16 of the pre-selection cam 5 has a V-shaped or dovetail-shaped section, so as to surround, when it is engaged to the pre-selection cam 30, the upper surface 31 and the lower surface 32 of the pre-selection cam 30 defining a tip-shaped or wedge-shaped section.

Preferably, the V-shaped section of the actuating butt 16 of the pre-selection element 5 has a bottom point designed to match the tip of the pre-selection cam 30, along the curved profile defined by the pre-selection cam itself. Preferably, the aforesaid pivot 18 corresponds to the bottom point.

Preferably, the operating portion 8 of the activation element 7 preferably acts upon the connecting portion 6 of the pre-selection element 5 belonging to the same needle-sinker assembly 1, and this action is preferably a selective pushing action.

Preferably, the activation element 7 is shaped as a flat bar and comprises:

- a respective shaft 41, preferably lying in the same radial groove 4 of the respective sinker P;
- the aforesaid operating portion 8, preferably defined on a front end 42 of said shaft (facing the central axis X);
- a control portion 43, preferably defined on a rear end 44 of the shaft 41 (outer end with respect to the central axis X) and comprising a control butt 45 configured for engaging, in given angular sectors around the sinker-holding ring A, an activation cam 50 belonging to the control cams of the sinkers (placed on the sinker cover T).

Preferably, the activation element 7 is positioned, in use, on a plane on which the connecting portion 6 of the corresponding pre-selection element 5 is positioned. Basically, in use the activation element 7 and the connecting portion 6 of the pre-selection element 5 are both positioned substantially in the same radial plane (getting through the central axis X).

Preferably, the activation element 7 is positioned, in use, at least partially in a plane in which lies the radial groove 4 housing the sinker P belonging to the same needle-sinker assembly 1.

Preferably, the activation element 7 is wholly made as one piece.

Preferably, the activation element 7 has in all its parts a basically constant thickness.

Preferably, the shaft 41, the operating portion 8 and the control portion 43 are integral with each other and mutually positioned in a stationary manner.

Preferably, the activation element 7 is positioned, in use, at least with its shaft 41 and the operating portion 8 that are co-planar with the respective sinker P and so as to be at least partially below the sinker body 21 (with respect to the sinker cover T). In this case, as in the embodiment shown in the figures, the activation element 7 is an "under-sinker" member.

Preferably, the activation cam 50 is shaped so as to enable the engagement of the control butt 45 of the activation elements 7 in certain angular sectors around the sinker-holding ring A only.

Preferably, the activation cam 50 defines an insertion path with which the aforesaid control butt 45 of the activation element 7 is engaged so as to guide the movement thereof, inside the respective radial groove 4, approaching (or away from) the central axis X in accordance with a "law of insertion motion" (differing from the aforesaid "law of basic motion"). This is achieved by suitably profiling both the activation cam and the sinker cam.

Preferably, the law of insertion motion causes a movement of each activation element 7, previously pre-selected by means of the respective pre-selection element 5, which makes the operating portion 8 thereof push the connecting portion 6 of the pre-selection element 5 belonging to the same needle-sinker assembly 1 so that the connecting portion 6 moves towards the central axis X and, being engaged into the connecting seat 9 of the sinker P, pushes in its turn the sinker P into the radial groove 4 towards the central axis X, causing an "insertion movement" of the sinker P and thus performing the aforesaid activation (or "selection") of the sinker P.

Preferably, the pushing action of the operating portion 8 of the activation element 7 upon the connecting portion 6 of the pre-selection element 5 causes the aforesaid insertion movement of the sinker P, which differs from the aforesaid basic movement caused by the sinker cam 71.

Basically, the insertion movement suitably changes the basic movement of the sinker P and makes it execute a movement towards the central axis X in accordance with a different law of motion.

Once the activation element 7 (by means of the pre-selection element 5) has ended its pushing action, and after resuming the movement imparted by the sinker cam 71 to the butt 22' and/or to the counter-butt 22" of the sinker, the movement of the sinker P is again the basic movement.

In other words, if the activation element 7 acts upon the pre-selection element 5 and the latter is in the pre-selection configuration (in which the connecting portion 6 is engaged into the connecting seat 9 of the sinker), the sinker P executes the insertion movement towards the central axis X (thanks to the activation cam 50) instead of executing the basic movement (which occurs thanks to the sinker cam 71 only).

Basically, in case of pre-selection and activation, the insertion movement of the sinker P replaces temporarily and/or partially the basic movement and suitably changes it.

The activation (or selection) of the sinker P by both elements, pre-selection element 5 and activation element 7, of a given needle-sinker assembly 1 corresponds to or causes the execution of a movement of the sinker P in accordance with the law of insertion motion.

The activation (or selection) of the sinker P by the activation element 7 (actuated by the activation cam 50), and the execution of the insertion movement, occur only provided that the corresponding needle N has (previously) caused, by means of its ascending motion, the vertical movement of the corresponding pre-selection element 5 as far as the aforesaid pre-selection configuration.

Preferably, the thrust by the operating portion 8 of the activation element 7 upon the connecting portion 6 of the pre-selection element 5, as a result of the translation imparted to the activation element 7 by the activation cam 50, may cause the oscillation of the pre-selection element around the aforesaid pivot 18, approaching the central axis X.

Preferably, in the condition in which:

- the pre-selection element 5 is in the pre-selection configuration;
- the butt 22' and the counter-butt 22" of the sinker P engage the sinker cam 71 so as to execute the basic movement;
- the sinker cam 71 causes a backward movement of the sinker P inside the respective radial groove 4, away from the central axis X of the needle-holding cylinder C;
- the needle-sinker assembly 1 is configured for performing the following actions:
- the sinker P, getting back as a result of the basic movement caused by the sinker cam 71, pushes with its connecting seat 9 the connecting portion 6 of the pre-selection element 5 and makes it rotate/oscillate around the pivot 18 away from the respective needle N (i.e. getting back with respect to the central axis X of the needle-holding cylinder C);
- the pre-selection element 5 pushes in its turn the operating portion 8 of the activation element 7 making the activation element 7 get back away from the central axis X of the needle-holding cylinder C;
- this causing the activation element 7 to be positioned in a loading configuration in which it is ready to execute the movement imparted by the activation cam 50.

In the loading configuration the sinker P and the activation element 7 are taken out with respect to the needle-holding cylinder C, i.e. they are away from the central axis X.

Preferably, starting from the loading configuration the activation element 7, as a result of the activation cam 50, moves approaching the central axis X and pushes with its operating portion 8 the connecting portion 6 of the pre-selection element 5, which moves in its turn towards the central axis X and pushes the sinker P into the radial groove 4 towards the central axis X, executing said insertion movement of the sinker P.

Basically, the aforesaid actions (in particular the activation element 7 getting back) allow to "load" the activation element 7 and thus to load the respective sinker P: thus the assembly 1 is ready to execute the aforesaid insertion movement (which changes the law of motion of the sinker P with respect to the basic movement) starting from the activation cam 50.

Preferably, the activation element 7 is configured for moving away from the central axis X as a result of a thrust of the respective pre-selection element 5 (when it rotates/oscillates), and approaching the central axis X as a result of the motion imparted by the activation cam 50.

Preferably, the activation element 7 is configured for not imparting any movement or thrust directly to the respective sinker P (but only by means of the pre-selection element 5).

Preferably, the activation element 7 is configured for being pushed by or for pushing the respective pre-selection element 5 only.

As a matter of fact, it should be noticed that the activation element 7 receives a thrust by the pre-selection element 5 (as a result of the respective sinker P getting back, which makes it rotate/oscillate outwards) so as to get back with respect to the central axis X, while it imparts a thrust to the activation element 5 when it proceeds to the central axis X (as a result of the activation cam 50).

Preferably, the pre-selection element 5 (in particular the connecting portion 6 thereof) is configured for:

- executing a vertical/axial (preferably shifting) movement as a result of the ascending motion of the corresponding needle N until the pre-selection configuration is reached; and
- executing a horizontal/radial (preferably oscillating or rotational) movement as a result of the translation of the corresponding sinker P in the respective radial groove 4 by means of the sinker cam 71 or as a result of the thrust imparted by the corresponding activation element 7 (thanks to the activation cam 50).

It should be noticed that the horizontal/radial movement of the pre-selection element 5 is a movement away from the central axis when it occurs as a result of the corresponding sinker P being taken out, whereas it is a movement approaching the central axis when it occurs as a result of the thrust imparted by the corresponding activation element.

Preferably, the functional portion 23 of the sinker P comprises an auxiliary plane 25 designed, when the sinker P executes the aforesaid insertion movement imparted by the activation element 7, to be positioned between two adjacent needles N so as to receive one or more yarns resting thereon, hooked by the needles getting back into the longitudinal grooves 3 of the needle-holding cylinder C, for making a special stitch.

Preferably, the auxiliary plane 25 is a raised plane (i.e. vertically distanced in a direction parallel to the central axis X) with respect to the basic plane 24, and said special stitch formed by the auxiliary plane is a terry stitch.

The figures show by way of example a sinker P equipped in its functional portion 23 (i.e. the front portion) of the basic plane 24 and of the auxiliary plane 25: in the example shown, the auxiliary plane 25 is a plane configured for executing, when the sinker makes the insertion movement, terry stitches.

In general, the auxiliary plane can be configured for executing also different knitting operations: based on the special stitch to be made a suitable sinker P suitably shaped can be selected. The solution of the present invention can be implemented even if the type of sinker P used is changed: the structure of the needle-sinker assembly and the control cams acting upon the elements allows to execute the selection of the sinker and to make it execute, in a controlled manner, the basic movement and the insertion movement.

Preferably, the elements constituting the needle-sinker assembly 1, i.e. the needle N, the holding-down sinker P, the pre-selection element 5 and the activation element 7 are made as flat, thin plates, with a greater length and width (or height) than the thickness.

Preferably, the needle N, the holding-down sinker P, the pre-selection element 5 and the activation element 7 are flat elements, preferably metal elements.

Preferably, the needle N, the holding-down sinker P, the pre-selection element 5 and the activation element 7 are elements obtained by cutting, stamping and/or bending flat bars.

It should be noticed that the wording "wherein each needle is paired with at least one respective adjacent sinker thus forming a needle-sinker assembly" includes also a possible embodiment (not shown) in which said "at least one respective sinker" comprises (or consists of) a pair of adjacent sinkers, preferably a right sinker and a left sinker, both paired with the same needle. In this case each needle is paired with two sinkers and the needle-sinker assembly comprises at least three elements (to which at least one pre-selection element and at least one activation element should be added).

Preferably, the needle-holding cylinder C may comprise a first stopping member placed outside the longitudinal grooves 3 and configured for stopping the ascending motion of the pre-selection elements 5 at a first vertical height corresponding to the height at which the actuating butts 16 of the pre-selection elements engage onto the pre-selection cam 30 (i.e. the pre-selection elements 5 are in the pre-selection configuration).

Preferably, the first stopping member is located, along a direction parallel to the central axis X (i.e. in a vertical direction), above the actuating portions 12 of the pre-selection elements 5.

Preferably, the stopping action during the ascending motion of the pre-selection element 5 occurs when the actuating portions 12 abut against the first stopping member, which prevents the pre-selection element from ascending further.

Preferably, the first stopping member is located, with respect to the needle-holding cylinder C, so as to be radially placed between the needles N (in particular the shafts 63 of the needles) and the pre-selection elements (in particular the shafts 11 of the pre-selection elements).

Preferably, the first stopping member is a spring or a circular, thread-like element surrounding circumferentially the whole needle-holding cylinder C.

Preferably, the needle-holding cylinder may comprise a second stopping member places outside the longitudinal grooves 3 and configured for stopping the descending motion of the pre-selection elements 5 at a second vertical height at which the connecting portions 6 of the pre-selection elements 5 do not engage the connecting seats 9 of the sinker P (i.e. the pre-selection elements 5 are not in their "pre-selection configuration" and the actuating butts 16 do not engage the pre-selection cam 30).

Preferably, the second vertical height is smaller than the first vertical height.

Preferably, the pre-selection elements 5 comprise each a respective stopping butt 17 configured for abutting, as a resulting a descent of the pre-selection element, against the second stopping member, thus preventing the pre-selection element 5 from descending further.

Preferably, the second stopping member is located, along a direction parallel to the central axis X, below the stopping butts 17 and above the actuating portions 12 of the pre-selection elements 5.

Preferably, the second stopping member is located, along a direction parallel to the central axis X, above the first stopping member.

Preferably, the second stopping member is located, with respect to the needle-holding cylinder X, so as to be radially placed between the needles N (in particular the shafts 63 of the needles) and the pre-selection elements 5 (in particular the shafts 11 of the pre-selection elements).

Preferably, the second stopping member is a spring or a circular, thread-like element surrounding circumferentially the whole needle-holding cylinder C.

Basically, the vertical motion (i.e. the stroke) of the pre-selection element 5 is preferably limited within the axial distance between the actuating portion 12 and the stopping butt 17, which stop the ascending and descending motion against the first and second stopping member, respectively.

Preferably, each needle-sinker assembly 1 comprises a respective selector 80, at least partially arranged slidingly in the respective longitudinal groove 3 below the needle N, and axially movable in a selective manner so as to command the ascending motion of the needle in the respective longitudinal groove.

Preferably, each selector 80 has at least one respective butt radially movable between an operating position, in which it is extracted so as to engage with respective paths defined by selection cams, and a non-operating position, in which it is retracted so as not to engage with said paths defined by selection cams.

Preferably, the needle-holding cylinder C comprises at least one selecting device acting under control upon the selectors 80 for switching the latter into or retaining them in the operating position or the non-operating position.

The use of a needle-sinker assembly 1 according to the present invention in a circular knitting machine will now be described. Let us observe FIGS. 1-8.

Figure 1:
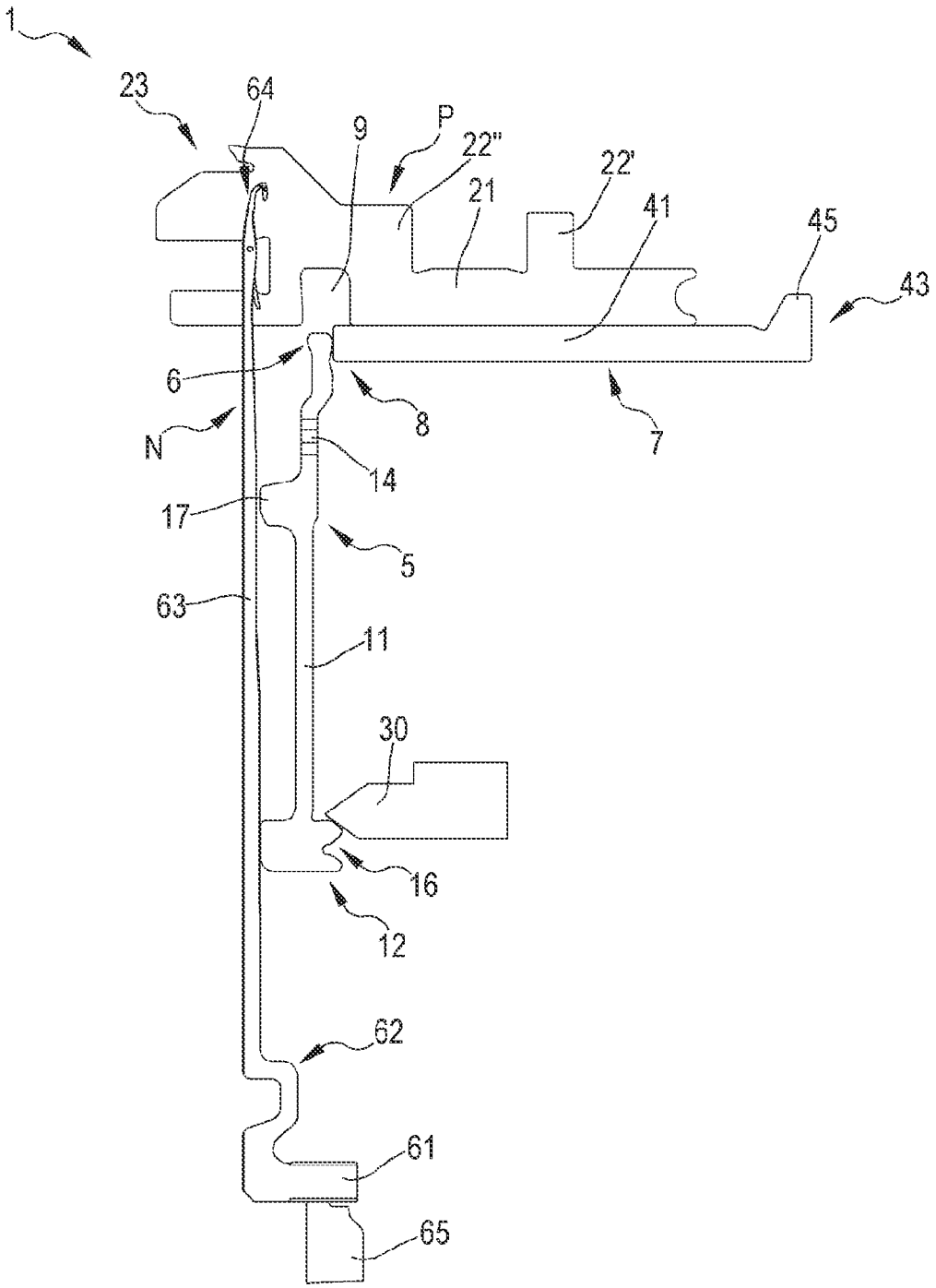
FIG. 1 shows a sectioned view of a portion of a circular knitting machine for knitwear according to the present invention, in accordance with a possible embodiment, some parts being removed and showing in particular the elements of the needle-sinker assembly in a first condition during the operating cycle of the knitting machine; it should be noticed that the section of FIG. 1 is made on a radial (vertical) plane getting through the central axis and on which the needle and the pre-selection element lie, but at the same time elements such as the sinker and the activation element can be seen, located behind on another radial plane offset with respect to the needle plane.

FIG. 1 shows the needle-sinker assembly 1 in the initial configuration of a stitch forming cycle.

The needle N can be seen, located below the pre-selection element 5, which is in a lowered position and whose connecting portion 6 is not engaged into the connecting seat 9 of the sinker P.

Figure 2:
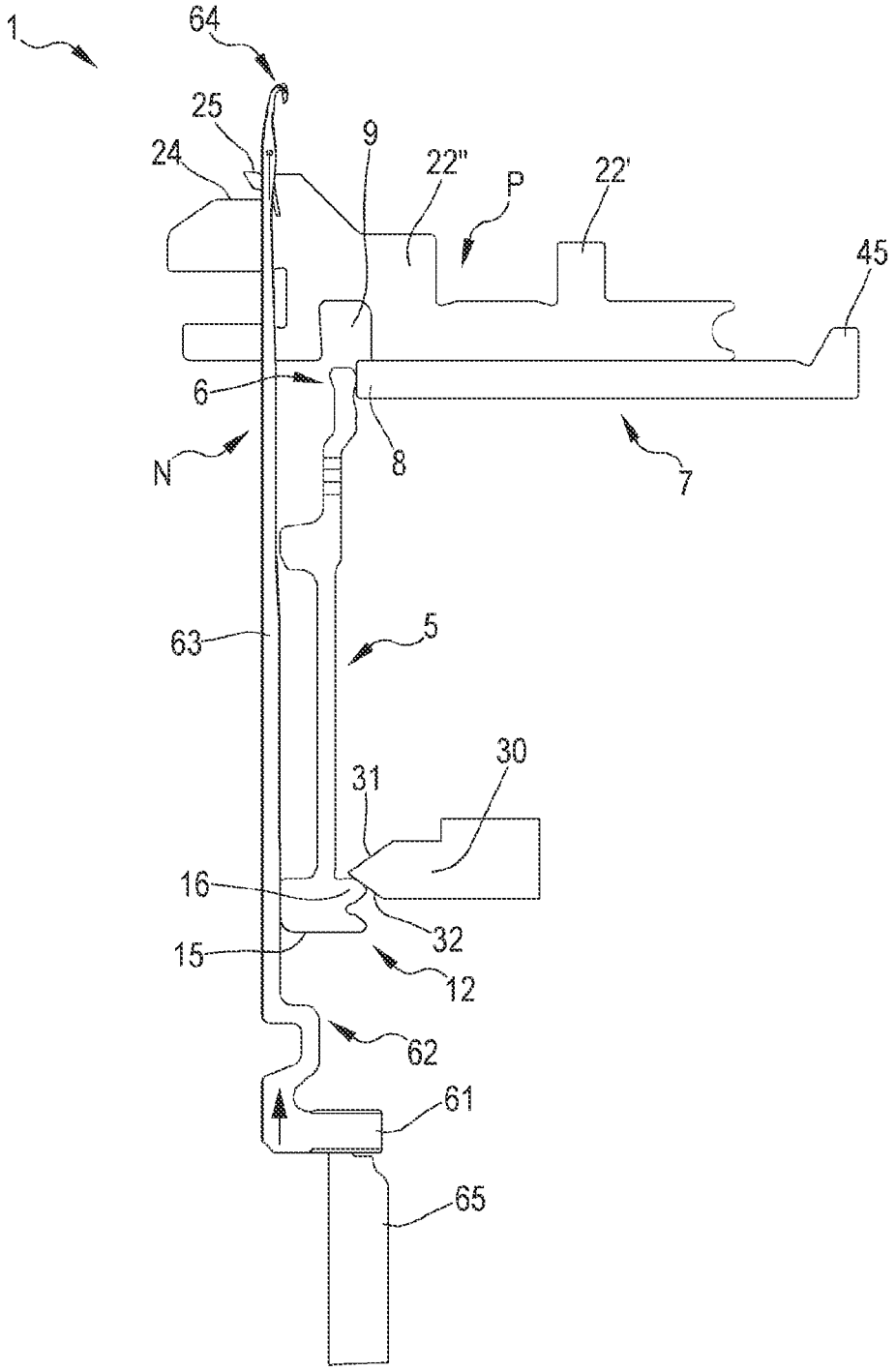
FIG. 2 shows the elements of FIG. 1 in a second condition during the operating cycle of the knitting machine.

In FIG. 2 the control cam 65 of the needles N acts upon the butt 61 of the needle and causes a vertical movement of ascent thereof (see the arrow indicating this movement). The remaining elements of the needle-sinker assembly 1 (i.e. the pre-selection element, the activation element and the sinker) are still in the same position of FIG. 1.

Figure 3:
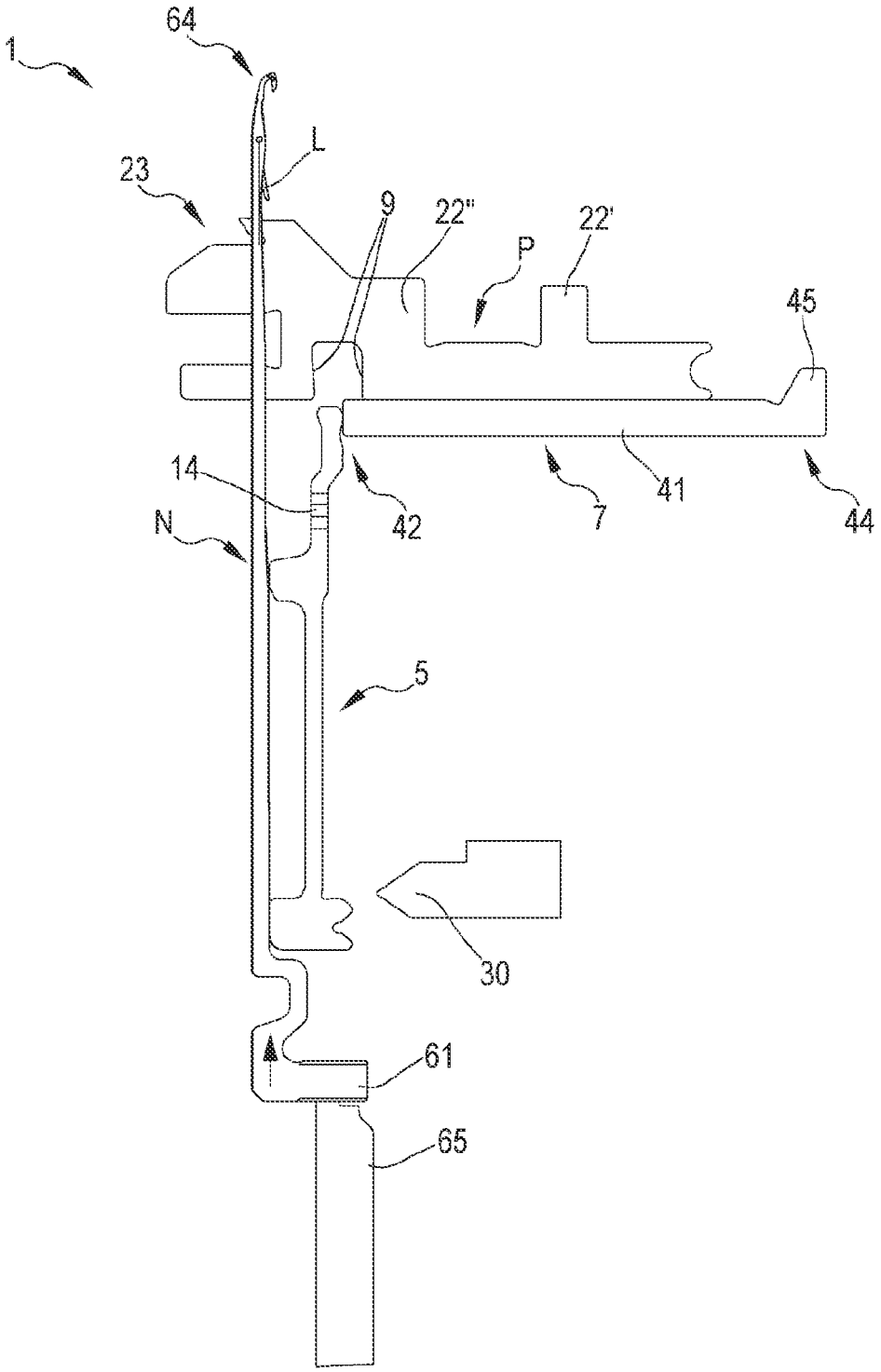
FIG. 3 shows the elements of FIG. 1 in a third condition during the operating cycle of the knitting machine.

In FIG. 3, the needle N ascends and reaches with its pushing portion 62 the actuating portion 12 of the pre-selection element 5; in particular, the pushing portion 62 is going to be in contact with the lower surface 15 of the actuating portion 12. In the meanwhile, the pre-selection cam 30, in the sector of the needle-holding cylinder in which the needle ascends until reaching the pre-selection element, is shaped so that its profile allows the actuating butt 16 of the pre-selection element to ascend (notice that the profile of the cam 30 is radially away from the actuating butt 16).

Figure 4:
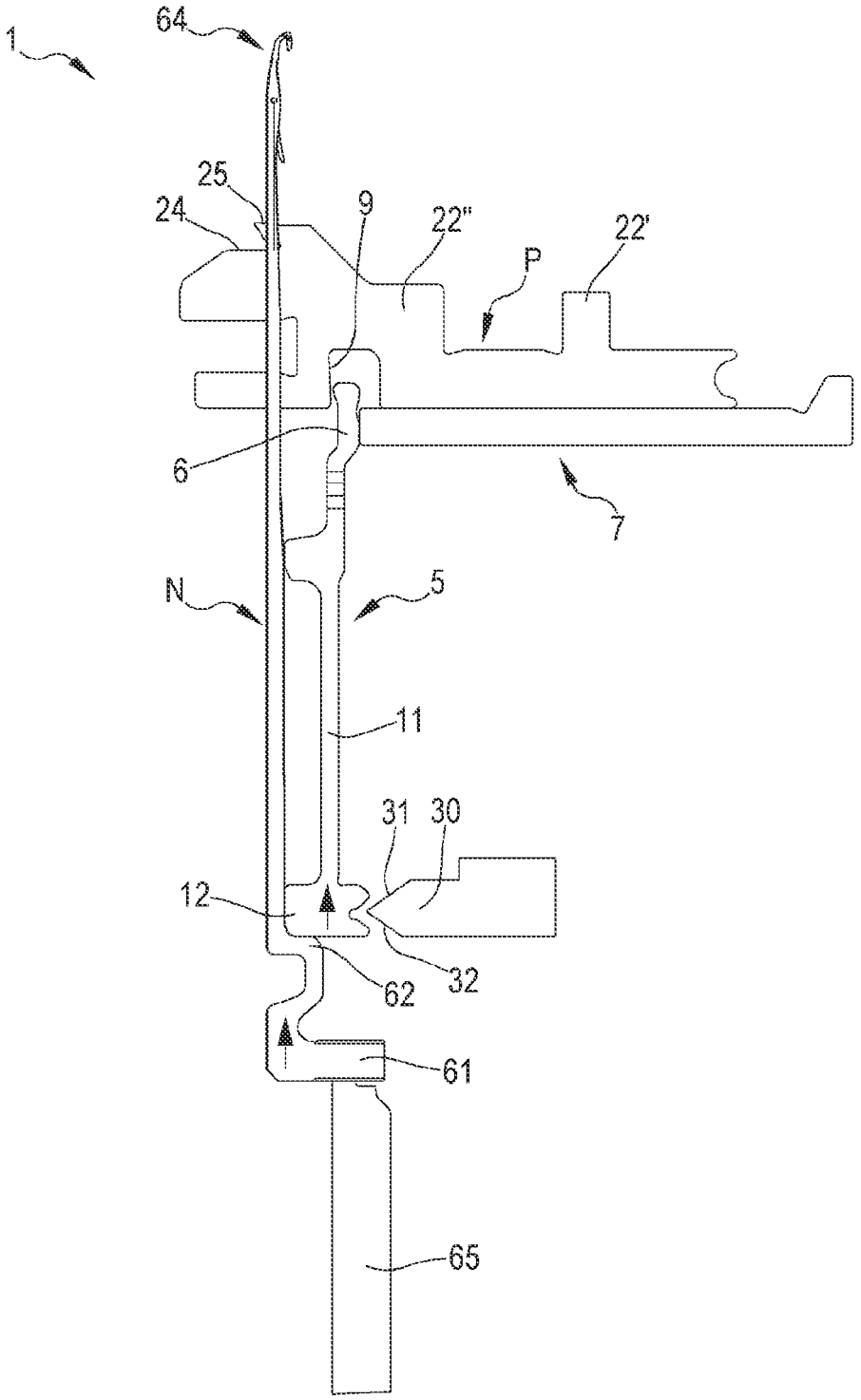
FIG. 4 shows the elements of FIG. 1 in a fourth condition during the operating cycle of the knitting machine.

In FIG. 4, the needle N has reached the pre-selection element 5 and continues ascending: the pushing portion 62 interacts with the actuating portion 12 and thus causes the pre-selection element 5 to ascend (see the two arrows in FIG. 4). In this configuration, the needle N and the pre-selection element 5 ascend together and the connecting portion 6 engages into the connecting seat 9 of the sinker P: this engagement occurs by means of the connecting portion 6 being inserted into the lower recess of the sinker, and causes the aforesaid "pre-selection configuration" to be reached by the pre-selection element. It should further be noticed that, as a result of the ascending motion, the actuating butt 16 of the pre-selection element reaches a height at which its V-shaped (or dovetail-shaped) section is aligned with the tip-shaped section of the pre-selection cam 30, so that the butt 16 can engage with the cam 30.

Figure 5:
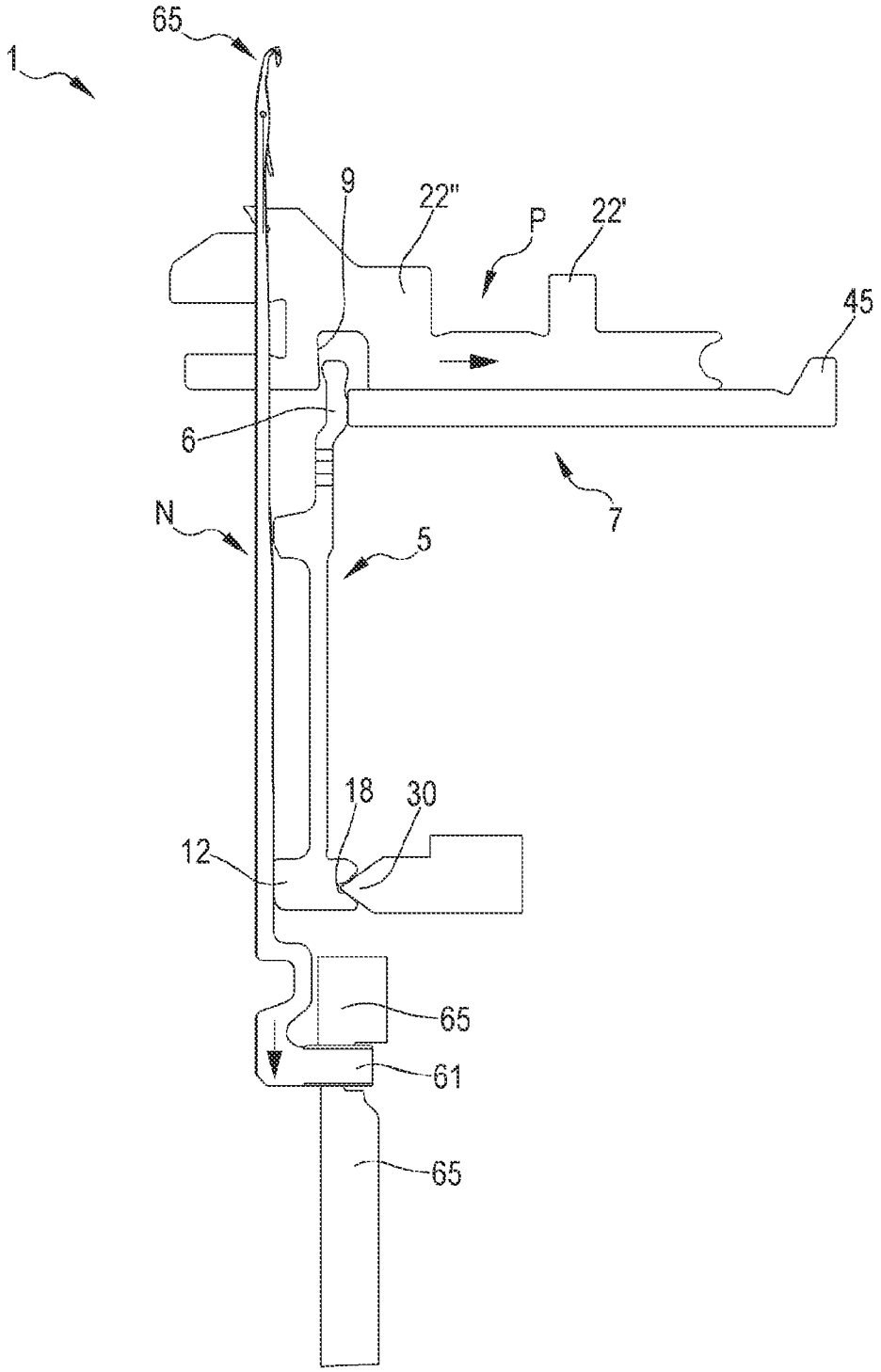
FIG. 5 shows the elements of FIG. 1 in a fifth condition during the operating cycle of the knitting machine.

In FIG. 5 the actuating butt 16 has been engaged with the pre-selection cam 30: this means that from now on the pre-selection element 5 is vertically supported by the pre-selection cam and it is no longer necessary to support the needle N. As a matter of fact, it should be noticed that the needle N proceeds with its law of motion moving downwards thanks to the needle cam 65 (which in this figure has a double profile surrounding the butt 61).

Simultaneously, or afterwards, the sinker P begins a radial movement away from the central axis X (see the horizontal arrow pointing to the right in FIG. 5): this movement of the sinker is caused by the sinker cam 71 acting upon the butt 22' of the sinker.

It should further be noticed that, starting from FIG. 4 to FIG. 8, the pre-selection element 5 remains in the pre-selection configuration, i.e. its connecting portion 6 is inserted into the connecting seat 9.

Figure 6:
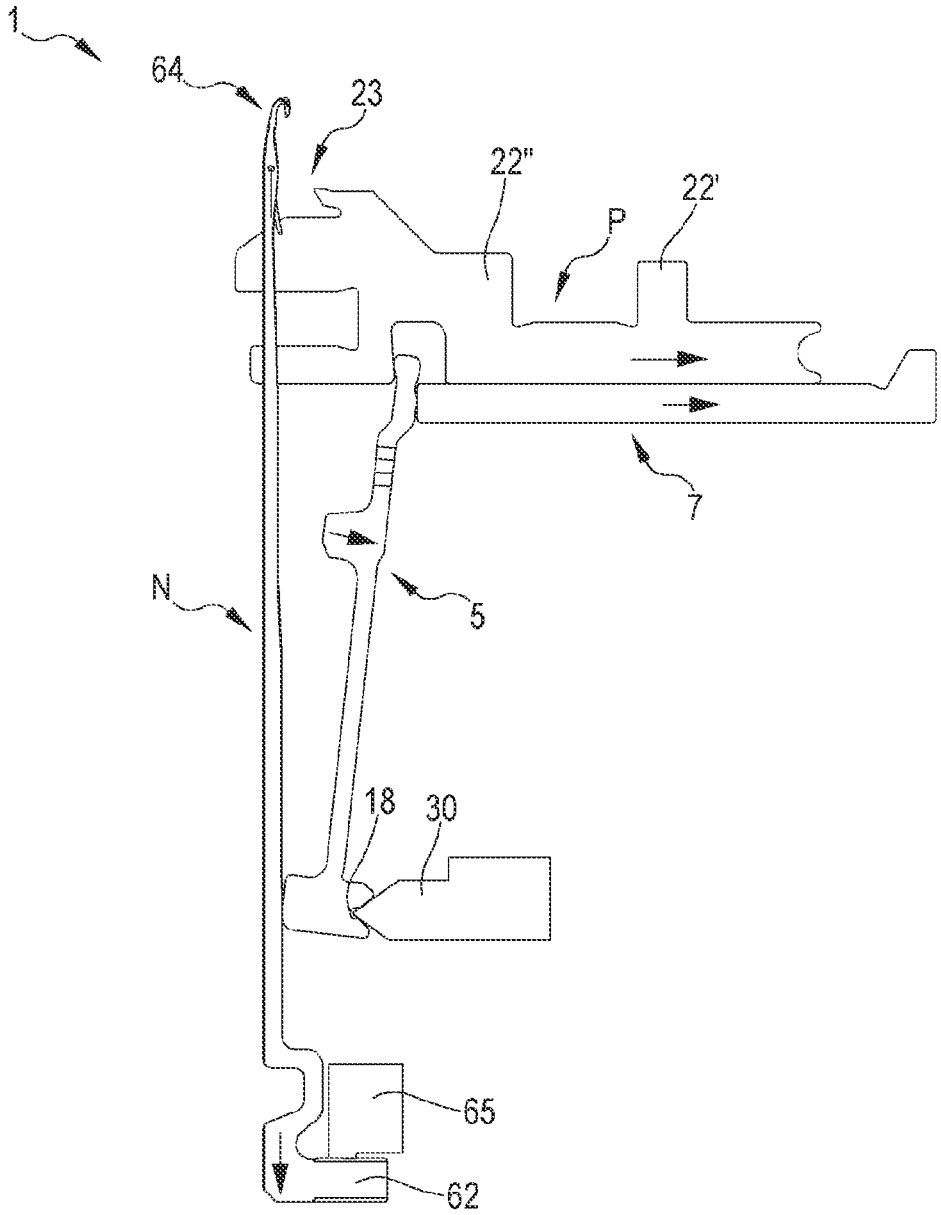
FIG. 6 shows the elements of FIG. 1 in a sixth condition during the operating cycle of the knitting machine.

FIG. 6 shows the "loading" step of the activation element 7 (i.e. the sequence of operations enabling to "trigger" the activation element): the sinker P gets back in accordance with the law of basic motion imparted by the sinker cam 71, and thus causes the pre-selection element 5 to oscillate/rotate around the pivot 18, since the connecting portion 6 is engaged into the connecting seat 9 which gets back and pushes against it causing it to get away from the respective needle N. The connecting portion 6 in its turn gets back and pushes against the operating portion 8 of the activation element 7, which therefore gets back away from the central axis X. Therefore, as indicated by the arrows in FIG. 6, the sinker P getting back causes both the pre-selection element 5 and the activation element 7 to get back.

Figure 7:
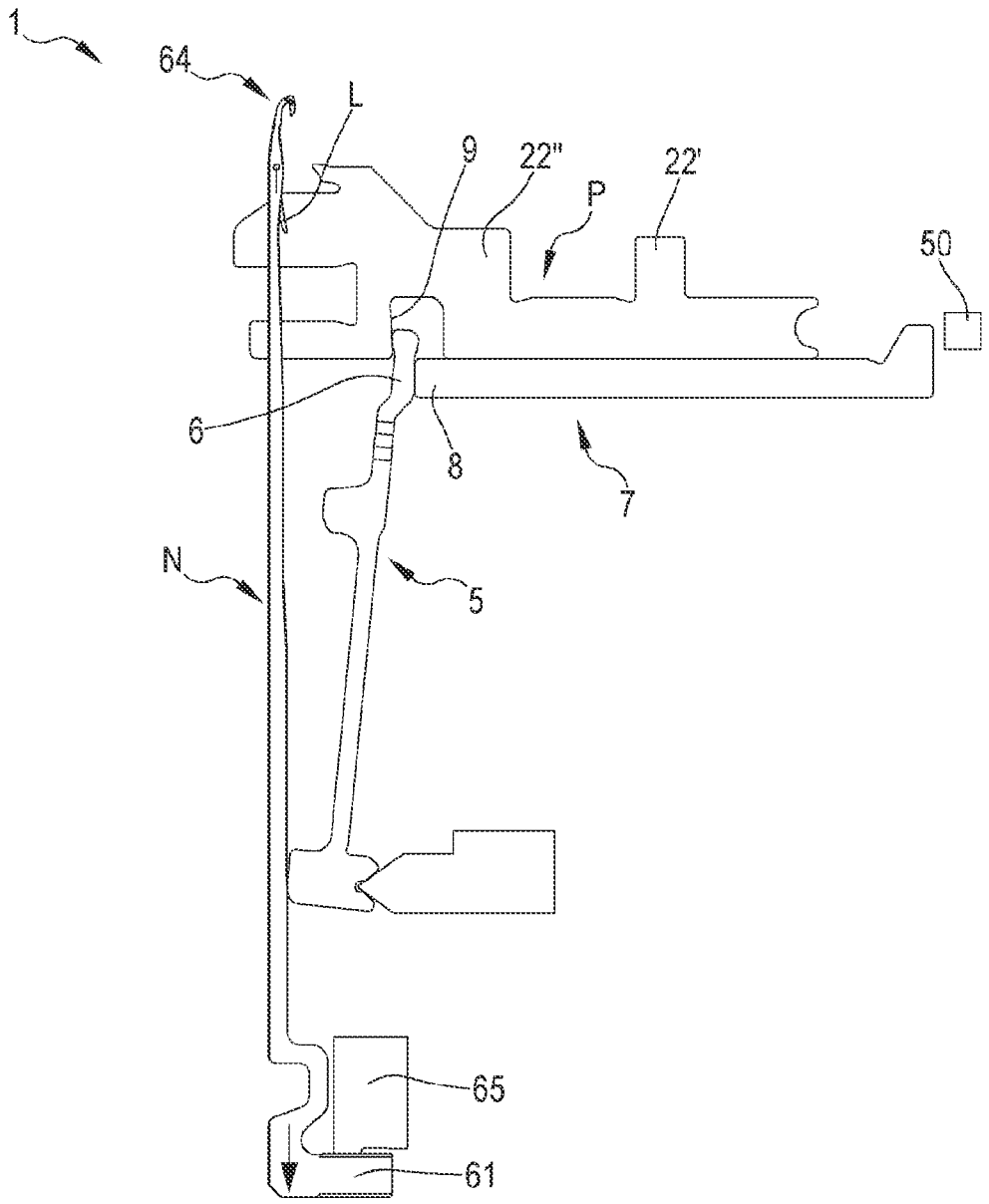
FIG. 7 shows the elements of FIG. 1 in a seventh condition during the operating cycle of the knitting machine.

At the end of the "loading" step, the needle-sinker assembly 1 is in the configuration of FIG. 7: the activation element 7 is "loaded", i.e. taken out and ready to receive the action of the activation cam 50 behind if special stitches are to be executed. FIG. 7 shows the needle N which is simultaneously descending and getting back into the respective longitudinal groove 3 as a result of the needle cam 65.

Figure 8:
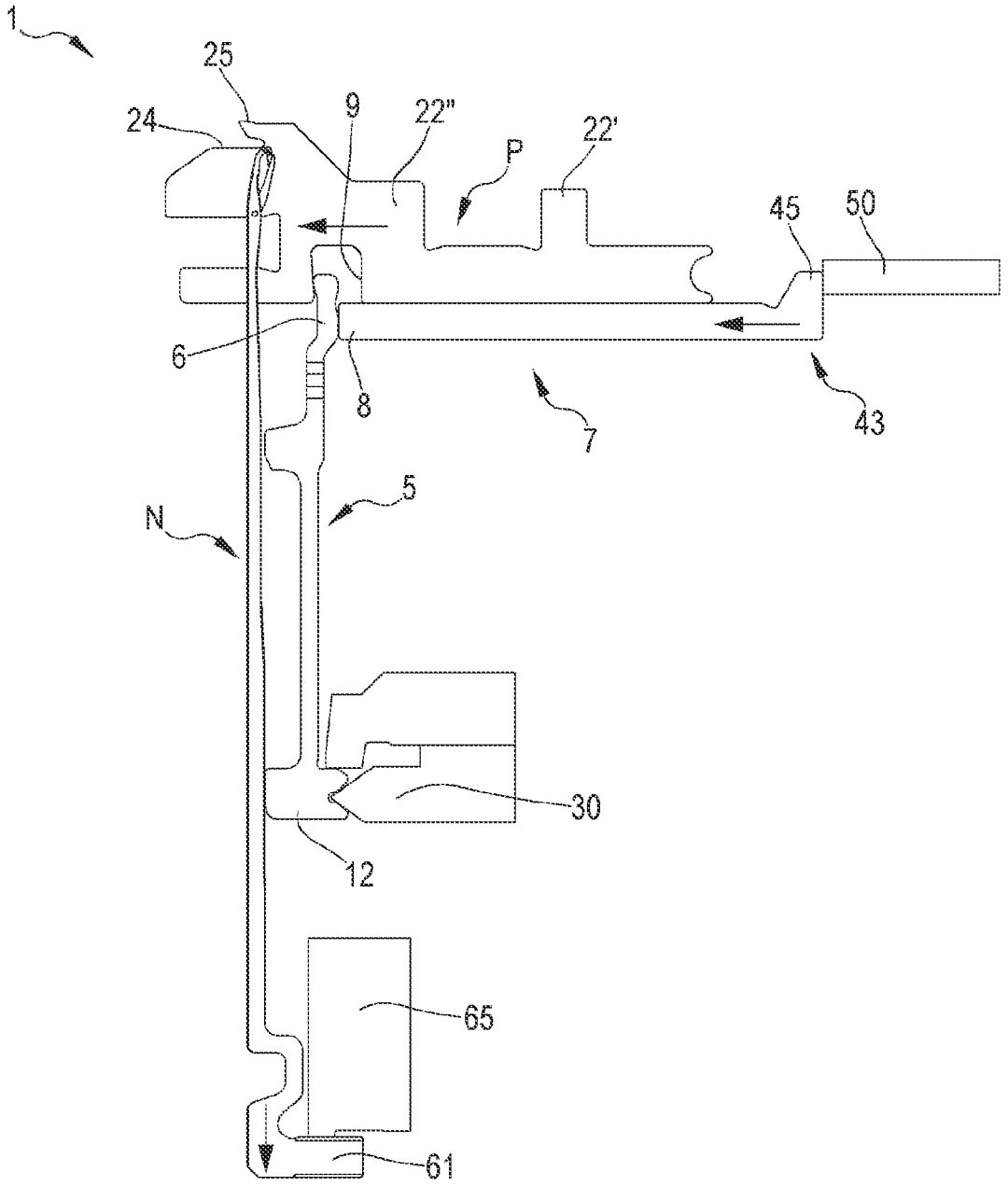
FIG. 8 shows the elements of FIG. 1 in an eighth condition during the operating cycle of the knitting machine.
Figure 9:
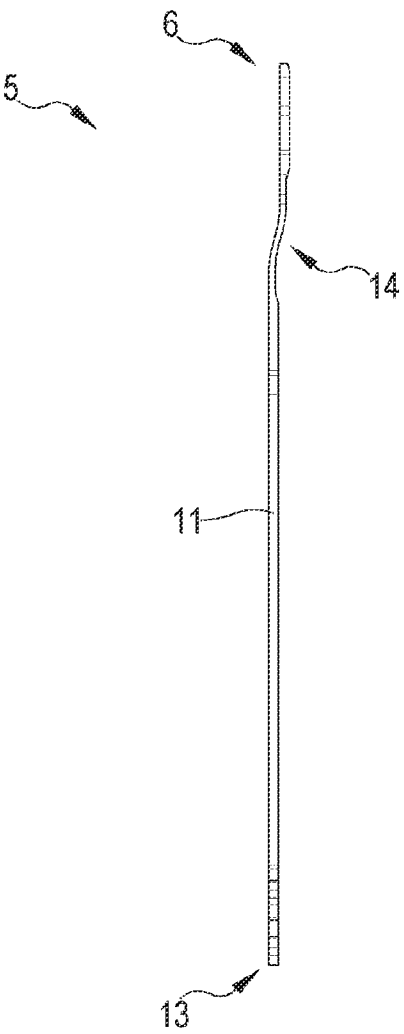
FIG. 9 shows a rear view of a possible embodiment of a pre-selection element belonging to the knitting machine, or to the needle-sinker assembly, according to the present invention (in particular it is the same pre-selection element as in FIGS. 1-8)

FIG. 8 shows the real "activation" step of the sinker P, which occurs thanks to the activation cam 50. As shown by the arrows, the activation cam 50 acts upon the control butt 45 of the control portion 43 of the activation element 7 by pushing it and causing it to proceed towards the central axis X. This forward movement causes a pushing action by the operating portion 8 of the activation element 7 upon the connecting portion 6, which causes an oscillation/rotation of the pre-selection element 5 (around the pivot 18 engaged onto the tip of the pre-selection cam 30) towards the central axis X. Moreover, since the connecting portion 6 has been previously inserted into the connecting seat 9 of the sinker, the oscillation of the pre-selection element 5 causes in its turn a subsequent forward movement of the sinker P towards the central axis X: this forward movement is exactly the aforesaid "insertion" movement of the sinker P in accordance with the law of insertion motion caused by the activation cam 50 (which "replaces" the basic movement caused by the sinker cam 71).

Simultaneously, as shown in FIG. 8, the needle N continues its movement for getting back into the respective groove: the needle, after collecting the yarns, descends to a height at which the head 64 is located below the functional portion 23 of the sinker P causing the knitted loop previously formed to be knocked over (see the tab L of the head in closed position) and completing the formation of a new stitch.

It should be noticed that, if the activation cam 50 is not activated or used, the sinkers P do not execute the insertion movement and therefore no special stitch is executed since the sinkers continue on their path as actuated by the sinker cam which then imparts a basic movement.

Preferably, the control cams of the needle-holding cylinder may comprise a reloading cam of the pre-selection elements, configured for lowering the pre-selection elements after stitch formation (i.e. as a result of the configuration of FIG. 8), bringing them back to a low position from which they will start again at the following needle ascent. Preferably, the reloading cam acts upon the actuating portions of the pre-selection elements.

Therefore, each pre-selection element is raised by the respective needle, kept at the pre-selection height by the pre-selection cam and brought back to the low position by the reloading cam.

The present invention further relates to a knitting method comprising the steps of:

- arranging a circular knitting machine as described above, i.e. equipped with a needle-holding cylinder C, a plurality of needles N, a sinker-holding ring A, a plurality of holding-down sinkers P and needle-sinker assemblies 1 comprising each a pre-selection element 5 and an activation element 7;
- performing a knitting operation by means of one or more of the needle-sinker assemblies 1 for making stitches, by means of the steps of:
  - vertically moving, in a selective manner, the needle N in the respective longitudinal groove 3 until the pre-selection element 5 is engaged (FIGS. 2-4);
  - vertically moving (FIG. 4) the pre-selection element 5, as a result of the ascending motion of the respective needle N, to a pre-selection configuration (FIGS. 4-8) in which the connecting portion 6 is engaged into the connecting seat 9 defined in the sinker P belonging to the same needle-sinker assembly, thus causing a pre-selection of the sinker P with the ascending motion of the corresponding needle N;
  - horizontally moving (FIG. 8) the activation element 7 towards the central axis X, as far as an activation/selection position in which the operating portion 8 of the activation element 7 acts upon the pre-selection element 5 belonging to the same needle-sinker assembly;
  - by means of the connecting portion 6 of the pre-selection element 5, upon which the operating portion 8 of the activation element 7 acts, moving the sinker P in the radial groove 4 towards the central axis X, thus activating/selecting the sinker P itself.

It should be noticed that the knitting operation executed by means of the method according to the present invention may basically correspond to the aforesaid stitch forming cycle as described with reference to FIGS. 1-8.

The invention further relates to a needle-sinker assembly 1 for circular knitting machines for knitwear, comprising:

a needle N;

at least one holding-down sinker P;

a pre-selection element 5;

an activation element 7, comprising one or more of the technical features described above.

The solution of the present invention advantageously implements a "needle-needle/sinker-sinker" selection, i.e. one may decide "needle by needle" (i.e. for any needle) whether it should pre-select the respective sinker, so that the sinker itself can then be activated (i.e. selected) by means of the activation element.

Thus a "sinker-by-sinker" selection is allowed, wherein each sinker can be pre-activated by means of the respective needle. The means which allow to pre-select for each single needle the respective sinker and then actually activate (i.e. select), if required, the sinker itself, are the pre-selection element and the activation element, respectively.

It should be noticed that the pre-selection elements, each one with its connecting portion to be inserted into the sinker seat, allow to pre-select specifically for each needle the respective sinker, and then the activation elements, with their operating portion, allow to activate singularly each sinker so as to make it execute the insertion movement and thus make a special stitch, based on the specific structure of the sinker used.

The operation of the solution of the present invention involves a specific cooperation of the pre-selection element and of the corresponding activation element: the activation of the sinker occurs by means of a thrust exerted by the activation element upon the pre-selection element, which acts upon the corresponding sinker (since it is inserted with its connecting portion into the connecting seat of the sinker) and causes the insertion movement thereof.

Therefore, if the pre-selection element has not been "inserted" with the connecting portion into the sinker (thanks to the respective needle ascending), the following action of the activation element (if activated) will not cause the insertion of the sinker since the action of the activation element will not be transferred to the sinker itself.

Thus, if the sinker has not been pre-selected by the needle, such sinker cannot then be activated and therefore there is no insertion.

The solution of the present invention includes a first vertical action (pre-selection) from the needle to the pre-selection element (which "connects" to the sinker), and a second horizontal action (activation), in a radial direction from outside to inside, from the activation element to the pre-selection element (connected to the sinker) and then from the latter to the sinker so as to make it advance.

The operation of the solution according to the present invention therefore involves a series of steps/actions:

first, the needle ascends and its pushing portion abuts against the actuating portion of the pre-selection element, pushing it so as to ascend together;

once a given height is reached, the actuating butt of the pre-selection element can engage with the pre-selection cam, which supports and keeps the position of the pre-selection element also as a result of a descending motion of the needle (which may proceed with its own law of motion);

the height at which the actuating butt of the pre-selection element is engaged with the pre-selection cam is the one at which the insertion of the connecting portion into the connecting seat (recess) on the lower part of the sinker occurs (or is completed);

once the connecting portion (tip) of the pre-selection element is within the seat, the sinker can be actuated by the sinker cam which takes it out to the outside with respect to the central axis of the needle-holding cylinder;

by taking the sinker out the pre-selection element (which pivots on the pre-selection cam) oscillates outwards and pushes outside the activation element, too;

in practice, the sinker cam which normally takes the sinker out (and makes it get back for knitting) now actually takes the pre-selection element (which is an "oscillating jack") out, too, since it is inserted with its connecting portion into the seat of the sinker;

then also the activation element (the "under-sinker") is taken out, since the connecting portion of the pre-selection element acts upon its operating portion pushing it outside;

this allows to "trigger" (i.e. arrange for operation or prepare by taking out) the activation element which, once the activation cam is engaged, will be actuated so as to shift towards the central axis and thus push inside the respective pre-selection element, which in its turn will cause the insertion of the corresponding sinker, too (since it is "connected" to the pre-selection element).

In the needle-sinker assembly, the activation element is first triggered (by moving the sinker and the pre-selection element back) and then activated by the activation cam so as to make the sinker execute the insertion movement.

Basically, when the activation cam pushes an activation element towards the central axis (i.e. it "inserts" it), the activation element moves the respective sinker only if the corresponding pre-selection element has first been pre-selected (i.e. inserted into the recess of the sinker). The activation elements activate the sinker having their pre-selection element inserted only; therefore, the pre-selection element is in practice a "drive" between the activation element and the sinker.

It should be noticed that the pre-selection element is configured for pre-selecting not only the respective sinker, but also its respective activation element being part of the same needle-sinker assembly.

It should be further pointed out that the activation element cannot be triggered if the respective pre-selection element has not been pre-selection (by means of the respective needle ascending).

The sinkers whose pre-selection element is not inserted proceed with the usual basic movement controlled by the sinker cam and are not inserted for executing special stitches (e.g. terry stitches); these sinkers are not affected by the respective activation element.

The solution of the present invention allows to pre-select every sinker when every needle makes its ascending motion: as a matter of fact, if all the needles ascend, all the pre-selection elements are inserted with their "tip" into the respective sinker: therefore, every sinker is ready to be inserted so as to make special stitches.

However, this occurs only if, then, the corresponding activation elements are set to motion by the activation cam: thus, if one does not want to active the real selection, the activation elements should not be engaged with the activation cam (so that the activation elements do not exert their thrust inwards and make the sinker advance).

Therefore, the vertical movement of the pre-selection elements, indeed, allows to pre-select all the sinker: it is then the horizontal movement of the activation elements (provided it occurs) to cause the real selection and insertion of the sinkers. The real selection (the action driving the execution of special stitches with the sinkers) is made by the activation cam, but the pre-selection elements allow to obtain always the single selection related to the working needle; it is therefore a "needle-by-needle" selection of the single sinkers, so as to make with them special stitches in the desired positions only.

A further technical solution of the present invention will now be described. In particular, a circular knitting machine for knitwear equipped with a particular sinker-holding ring is described. Reference should be made in this respect to FIGS. 13-17.

These figures show in a perspective view, in a sectioned view and from above a sinker-holding ring: it is designed to be part of a circular knitting machine for knitwear, e.g. as shown in FIG. 12. Basically, the technical solutions of FIGS. 13-17 can be implemented advantageously, though not exclusively, inside a knitting head in accordance with the technical solution of FIGS. 1-12.

The sinker-holding ring of FIGS. 13-17 is included in a circular knitting machine for knitwear comprising:

- a needle-holding cylinder C having a plurality of longitudinal grooves 3 arranged around a central axis X of the needle-holding cylinder C;
- a plurality of needles N, each being movably housed in a respective longitudinal groove 3 and configured for moving in a controlled manner inside the longitudinal groove.

The sinker-holding ring A is designed to be placed near an upper end of the needle-holding cylinder C and coaxial therewith, and has a plurality of radial grooves 4 arranged around the central axis X.

The knitting machine therefore comprises a plurality of holding-down sinkers P, each being movably housed, at least partially, in a respective radial groove 4 and configured for moving in a controlled manner inside the radial groove.

As already disclosed referring to FIGS. 1-12, the radial grooves 4 are angularly offset with respect to the longitudinal grooves 3, so that a circumferential alternation of longitudinal grooves 3 and radial grooves 4 is present around the central axis X, and wherein each needle N is paired with at least one respective adjacent sinker P thus forming a needle-sinker assembly 1.

The knitting machine comprises, for each needle-sinker assembly 1 or for each of the needle-sinker assemblies 1 of a sub-set of needle-sinker assemblies:

- a pre-selection element 5, paired or operatively associated with the respective needle N and comprising a connecting portion 6 configured for selectively cooperating, either directly or indirectly, with said at least one adjacent sinker P belonging to the same needle-sinker assembly 1.

Preferably, the connecting portion 6, in use, is aligned with the radial groove 4 housing said at least one adjacent sinker P belonging to the same needle-sinker assembly 1.

As specifically shown in FIGS. 13-17, each radial groove 4 has a rear section 81 and a front section 91; the front section 91 develops continuously from the rear section 81 and is open frontally towards the central axis X.

Preferably, the front section 91 is longer than the rear section 81.

Preferably, the front section 91 is configured for laterally containing, at least partially, and guiding (at least) the connecting portion 6 of the pre-selection element 5 in its movements during the operating cycle of the knitting machine.

Preferably, the pre-selection element 5 is movably housed, at least partially, in the same longitudinal groove 3 of the respective needle N.

Preferably, the connecting portion 6 laterally rises from the longitudinal groove 3 so as to be aligned with the radial groove 4 housing said at least one adjacent sinker P.

Preferably, the radial groove 4 comprises a first cut 82 defining the rear section 81 and a second cut 92 defining the front section 91.

Preferably, the rear section 81 has a first width L1 and the front section 91 has a second width L2.

Preferably, the front section 91 has a greater development in width than the rear section 81, on both sides with respect to a lying plane (or an intermediate plane) of the rear section 81.

Preferably, the rear section 81 of the radial groove 4 is defined between two side walls 83 of the rear portion itself, facing each other and separated of an amount corresponding to the first width L1.

Preferably, the front section 91 of the radial groove 4 is defined between two lateral faces 93 of the front portion itself, facing each other and separated of an amount corresponding to the second width L2.

Preferably, the two lateral faces 93 of the front section 91 are laterally distanced with respect to the two side walls 83 of the rear section 81, so that the radial groove 4 widens from the rear section 81 to the front section 91.

Preferably, the two side walls 83 of the rear section 81 are vertical and parallel to one another.

Preferably, the two lateral faces 93 of the front section 91 are vertical and parallel to one another.

Preferably, the first width L1 corresponds to the distance between the two side walls 83 of the rear section.

Preferably, the second width L2 corresponds to the distance between the two lateral faces 93 of the front section.

The term "contain" means that the front section 91 movably houses, between its lateral faces 93, at least part of the connecting portion 6 of the respective pre-selection element 5 during its vertical/axial movement and/or its horizontal/radial movement.

The term "guide" means that the two lateral faces 93 of the front section 91 guide the connecting portion 6 of the respective pre-selection element 5 keeping it on a vertical lying plane during its vertical/axial movement and/or its horizontal/radial movement, and avoid lateral movements of the connecting portion 6 with respect to the vertical plane of the connecting portion (i.e. prevent the connecting portion from oscillating, during its movement, outside its vertical lying plane).

Basically, the front section is configured for movably containing and guiding the connecting portion 6 of the pre-selection element 5, basically acting as a "rail" within which the connecting portion may make its movements based on the actuation of the pre-selection element.

This advantageously allows to obtain a circular knitting machine operating with the needle-sinker assemblies described above an doing so in a safe, precise and reliable manner: as a matter of fact, the shape of the radial grooves of the sinker-holding ring (in particular the presence of the front section) allows to keep the pre-selection elements guided, thus avoid misalignments, positioning errors or faults or breaking events. Thus the needle-sinker assembly may correctly operate and execute a "needle-by-needle" selection of the single sinkers.

It should be noticed that the solution described above allows, by means of the front section 91 of the radial groove 4 (belonging to the sinker-holding ring A), to guide an object/element "coming" from the needle-holding cylinder C, i.e. the connecting portion 6 of the respective pre-selection element 5. In other words, the connecting portion 6, which is part of the pre-selection element 5 housed with its body in the longitudinal groove 3 of the needle-holding cylinder C and paired with a respective needle N, has its connecting portion 6 at least partially contained and guided by the front section 91 of the radial groove 4, which is part of the sinker-holding ring A.

Preferably, the rear section 81 is configured for laterally containing and guiding, at least partially, the respective sinker P in its translation movements, approaching or away from the central axis X, during the operating cycle of the knitting machine.

Preferably, the knitting machine comprises, for each needle-sinker assembly 1 or for each of the needle-sinker assemblies 1 of a sub-set of needle-sinker assemblies, an activation element 7, paired or operatively associated with the pre-selection element 5 and comprising an operating portion 8.

Preferably, the activation element 7 is movably housed, at least partially, in the same radial groove 4 housing the adjacent sinker P belonging to the same needle-sinker assembly 1.

Preferably, the rear section 81 is configured for laterally containing and guiding, at least partially, the respective activation element 7 in its translation movements, approaching or away from the central axis X, during the operating cycle of the knitting machine.

Preferably, the radial groove 4, and in particular the rear section 81, movably houses the respective sinker P and the respective activation element 7. Preferably, the activation element 7 is placed, at least partially, in a sliding manner below the sinker P.

Preferably, the operating portion 8 of the activation element 7 protrudes in the front part from the rear portion 81 of the radial groove 4 so as to be placed, in at least one operating condition of the knitting machine, between the two lateral faces 93 of the front section 91.

Preferably, the sinker P protrudes in the front part from the rear portion 81 of the radial groove 4 so as to be placed, with at least a part of its body 21, between the two lateral faces 93 of the front section 91.

Preferably, the operating portion 8 of the activation element 7 and part of the front end of the sinker P are movably housed, at least partially and under certain operating conditions of the knitting machine, in the space defined by the front section 91 of the radial groove 4 (which can be identified between the two lateral faces 93 of the front section).

Preferably, the first width L1 and the second width L2 are defined or calculated in a direction tangent to a circumferential development of the sinker-holding ring A (around the central axis X).

Preferably, the first width L1 (of the rear section) basically corresponds to the thickness of the sinker P housed in the radial groove.

Preferably, the first width L1 (of the rear section) basically corresponds to the thickness of the activation element 7.

Preferably, the second width L2 (of the front section) basically corresponds to the thickness of the connecting portion 6 of the pre-selection element.

"Basically corresponds to the thickness" means that the width is suitable to house accurately the respective element or part of it (sinker, activation element, pre-selection element), thus enabling the sliding movement thereof.

Preferably, the first cut 82 is made horizontally and on the whole radial length of the radial groove 4, whereas the second cut 92 is made vertically and crosses, i.e. overlaps, said first cut 82 so as to widen it and thus define the front section 91 having the second width L2, differing from the rear portion 81 having the first width L1.

In one aspect, the first cut 82 has a thickness corresponding to the first width L1 and the second cut 92 has a thickness corresponding to the second width L2.

Preferably, the two side walls 83 of the rear section 81 end above with a respective upper free edge 84 and below on a bottom surface (or hollow) of the radial groove.

Preferably, the two lateral faces 93 of the front section 91 end above with a respective upper free edge 94 and below with a respective lower free edge 95.

Preferably, the two upper edges 94 of the two lateral faces 93 of the front section 91 are longer, in a radial direction, with respect to the two lower edges 95.

Preferably, the second cut 92, defining the front section 91 with respect to the rear section 81, is vertically inclined so that the front section 91 has a greater radial extension in its upper end than the radial extension of its lower end.

Preferably, the second cut 92, which is made by crossing the first cut 82, forms two connecting steps 96 between the front section 91 and the rear section 81, on which the thickness of the radial groove 4 goes from the first width L1 to the second width L2, and vice versa.

Preferably, each connecting step 96 extends from the respective upper edge 94 to the respective lower edge 95 of the lateral face 93 of the front section 91.

Preferably, the second cut 92, vertically inclined, forms the two connecting steps 96 having an inclined or curved configuration.

Preferably, the two connecting steps 96 approach the central axis getting from the upper edges 94 of the two lateral faces 93 to the two lower edges 95 of the two lateral faces 93.

Preferably, each pair of adjacent radial grooves 4 defines therebetween a respective slat 97 or wall dividing them.

Preferably, each slat is shared by two adjacent radial grooves 4 and thus by two adjacent rear 81 and front sections 91.

Similarly, the front section 91 of each radial groove 4 is defined between two adjacent slats 97, wherein a lateral face 93 belongs to a right slat and the other lateral face 93 belongs to a left slat.

Similarly, the rear section 81 of each radial groove 4 is defined between two adjacent slats 97, wherein a side wall 83 belongs to a right slat and the other side wall 83 belongs to a left slat.

Each slat 97, due to the presence of the rear 81 and front portion 91 defined by the first 82 and second cut 92, exhibits two portions with different thicknesses:

- a first portion 98 defining the rear thickness of the slat 97, obtained between the rear sections 81 of two adjacent radial grooves 4;
- a second portion 99 defining the front thickness of the slat 97, obtained between the front sections 91 of two adjacent radial grooves 4.

The front thickness is smaller than the rear thickness, since the second width L2 is smaller than the first width L1.

Preferably, the operation described above of the whole needle-sinker assembly 1 (and in particular the pre-selection and activation steps) may be implemented advantageously in a knitting machine equipped with a sinker-holding ring A as shown by way of example in FIGS. 13-17.

The present invention therefore achieves important advantages both from a structural and a functional point of view. First of all, the Applicant has found out that the invention enables to solve the problems and overcome the limits listed above and typical of known solutions, and thus to obtain the intended aims. In particular, the structure and operation of the needle-sinker assembly 1 advantageously allow to:

- made a "needle-by-needle" selection of the single sinkers, i.e. an individual selection of the sinkers so as to execute with them special stitches in the desired positions only;
- manufacture fabrics with stitches having the most different features and in the desired positions;
- obtain fabrics with any "patterns" (i.e. areas with particular shapes and profiles) made with special stitches (e.g. terry stitches);
- manufacture fabrics in which for each knitted course any alternation of different stitches, i.e. desired sequences of plain and special stitches, are present, which enable to obtain "patterns" with special stitches having even complex profiles and shapes;
- manufacture high-quality knitted fabrics, which may also be highly complex, in relatively short times;
- increase the plurality of movements which can be assigned to the elements participating in the knitting process, in particular to the holding-down sinkers, so as to achieve a higher production flexibility, i.e. so as to manufacture different types of fabrics with several characteristics differing one from the other;
- obtain a circular knitting machine for knitwear characterized by a higher versatility for manufacturing knitted fabrics than known solutions;
- obtain a knitting machine which is able to manufacture knitted fabrics and obtain further motifs and/or effects on the knitted fabric without having to reconfigure the machine itself or parts of it from a mechanical point of view;
- obtain the possibility to make a "sinker-by-sinker" selection (thanks to the activation element) by means of a previous "needle-needle" selection (thanks to the pre-selection element).

What is explained above is obtained in particular thanks to the combination, in the needle-sinker assembly 1, of a vertical action/movement (pre-selection) by the pre-selection element, and of a horizontal action/movement (activation) by the activation element. This specific combination/synergy, which leads to the "stitch forming cycle" as described above (with particular reference to FIGS. 1-8), is wholly new and different from the known solutions as mentioned above.

A further advantage of the solution of the present invention consists in that it may be implemented in a simple and cost-effective way.

Moreover, the needle-sinker assembly according to the present invention represents an alternative solution to prior art.

The invention claimed is:

1. A circular knitting machine, comprising:

a needle-holding cylinder (C) having a plurality of longitudinal grooves (3) arranged around a central axis (X) of the needle-holding cylinder (C);

a plurality of needles (N), each being movably housed in a respective longitudinal groove (3) and configured for moving in a controlled manner inside the longitudinal groove;

a sinker-holding ring (A) placed near an upper end of the needle-holding cylinder (C) and coaxial therewith, the sinker-holding ring (A) having a plurality of radial grooves (4) arranged around the central axis (X) and, in use, being integral with the needle-holding cylinder (C);

a plurality of knockover sinkers (P), each being movably housed, at least partially, in a respective radial groove (4) and configured for moving in a controlled manner inside the radial groove;

wherein the radial grooves (4) are angularly offset with respect to the longitudinal grooves (3), so that a circumferential alternation of longitudinal grooves (3) and radial grooves (4) is present around the central axis (X), and wherein each of the plurality of needles (N) is paired with at least one respective adjacent sinker (P) thus forming a needle-sinker assembly (1), the knitting machine globally comprising a plurality of needle-sinker assemblies (1);

wherein the knitting machine comprises, for each needle-sinker assembly (1) of said plurality of needle-sinker assemblies, or for each of the needle-sinker assemblies (1) of a sub-set of needle-sinker assemblies:

a pre-selection element (5), paired or operatively associated with the respective needle (N) and comprising a connecting portion (6) configured for selectively cooperating, either directly or indirectly, with said at least one adjacent sinker (P) belonging to the same needle-sinker assembly (1);

an activation element (7), paired or operatively associated with said pre-selection element (5) and comprising an operating portion (8);

wherein the activation element (7) is movably housed, at least partially, in the same radial groove (4) housing said at least one adjacent sinker (P) belonging to the same needle-sinker assembly (1); and wherein:

the connection portion (6), in use, is aligned with the radial groove (4) housing said at least one adjacent sinker (P) belonging to the same needle-sinker assembly (1);

and wherein:

each of the plurality of radial grooves (4) has a rear section (81) and a front section (91), the front section developing in a continuous manner from said rear section and being open towards said central axis (X) on a front side of each of the plurality of radial grooves (4);

the front section (91) is wider than the rear section (81);

the front section (91) is configured for laterally containing, at least partially, and guiding the connecting portion (6) of the pre-selection element (5) in its movements during an operating cycle of the knitting machine.

2. The knitting machine according to claim 1, wherein:

each of the pre-selection elements (5) is movably housed, at least partially, in the same longitudinal groove (3) of the respective needle (N);

the connecting portion (6) laterally rises from the longitudinal groove (3) so as to be aligned with the radial groove (4) housing said at least one adjacent sinker (P).

3. The knitting machine according to claim 1, wherein each of the radial grooves (4) comprises a first cut (82) defining said rear section (81) and a second cut (92) defining said front section (91), and wherein the rear section (81) has a first width (L1) and the front section (91) has a second width (L2).

4. The knitting machine according to claim 1, wherein the rear section (81) of each of the radial grooves (4) is defined between two side walls (83) of the rear section (81), facing each other and separated of an amount corresponding to said first width (L1), and the front section (91) of the radial groove (4) is defined between two lateral faces (93) of the front section (91), facing each other and separated of an amount corresponding to said second width (L2);

and wherein the two lateral faces (93) of the front section (91) are laterally distanced with respect to the two side walls (83) of the rear section (81), so that each of the radial grooves (4) widens from the rear section (81) to the front section (91).

5. The knitting machine according to claim 4, wherein the two side walls (83) of the rear section (81) are vertical and parallel to each other, and wherein the lateral faces (93) of the front section (91) are vertical and parallel to each other;

and/or wherein the first width (L1) corresponds to the distance between the two side walls (83) of the rear section, and the second width (L2) corresponds to the distance between the two lateral faces (93) of the front section.

6. The knitting machine according to claim 4, wherein the front section (91) movably houses, between its lateral faces (93), at least part of the connecting portion (6) of the respective pre-selection element (5) during its vertical/axial movement and/or its horizontal/radial movement.

7. The knitting machine according to claim 1, wherein the front section is configured for movably retaining and guiding the connecting portion of each of the pre-selection elements, acting as a rail inside which the connecting portion can perform its movements based on how the pre-selection element is actuated, and/or wherein the rear section (81) is configured for laterally containing and guiding, at least partially, the respective sinker (P) in its translation movements, approaching and away from the central axis (X), during the operating cycle of the knitting machine.

8. The knitting machine according to claim 4, wherein the rear section (81) is configured for movably containing and guiding, at least partially, the respective activation element (7) in its translation movements, approaching and away from the central axis (X), during the operating cycle of the knitting machine;

and/or wherein each of the radial grooves (4) movably houses the respective sinker (P) and the respective activation element (7), the latter being placed, at least partially, slidingly below the sinker (P);

and/or wherein the operating portion (8) of the activation element (7) protrudes from the rear portion (81) of the corresponding radial groove (4) so as to be, in at least one operating condition of the knitting machine, interposed between the two lateral faces (93) of the front section (91).

9. The knitting machine according to claim 4, wherein the sinker (P) protrudes from the rear portion (81) of the corresponding radial groove (4) so as to be, at least with a part of a body (21) of the sinker (P), interposed between the two lateral faces (93) of the front section (91);

and/or wherein the operating portion (8) of the activation element (7) and part of a front end of the sinker (P) are movably housed, at least partially and under certain operating conditions of the knitting machine, in the space defined by the front section (91) of the corresponding radial groove (4), which can be identified between the two lateral faces (93).

10. The knitting machine according to claim 3, wherein the first width (L1) and the second width (L2) are defined or calculated in a direction tangent to a circumferential development of the sinker-holding ring (A) around the central axis (X);

and/or wherein the first width (L1) corresponds to the thickness of the sinker (P) housed in the corresponding radial groove and/or to the thickness of the activation element (7);

and/or wherein the second width (L2) corresponds to the thickness of the connecting portion (6) of each of the pre-selection elements (5).

11. The knitting machine according to claim 3, wherein said first cut (82) is made horizontally and on the whole radial length of each of the radial grooves (4), whereas said second cut (92) is made vertically and crosses, i.e. overlaps, said first cut (82) so as to widen it and thus define the front section (91) having the second width (L2), differing from the rear portion (81) having the first width (L1).

12. The knitting machine according to claim 4, wherein the two side walls (83) of the rear section (81) end above with a respective upper free edge (84) and below on a bottom surface of each of the radial grooves;

and wherein the two lateral faces (93) of the front section (91) end above with a respective upper free edge (94) and below with a respective lower free edge (95);

and wherein the two upper free edges (94) of the two lateral faces (93) of the front section (91) are longer, in a radial direction, with respect to the two lower free edges (95);

and/or wherein said second cut (92), defining the front section (91) with respect to the rear section (81), is vertically inclined so that the front section (91) has a greater radial extension in its upper end than the radial extension of its lower end.

13. The knitting machine according to claim 12, wherein said second cut (92), which is made by crossing said first cut (82), forms two connecting steps (96) between the front section (91) and the rear section (81), on which a width of each of the radial grooves (4) goes from said first width (L1) to said second width (L2), and vice versa;

and wherein each connecting step of the two connecting steps (96) extends from the respective upper free edge (94) to the respective lower free edge (95) of each of the lateral faces (93) of the front section (91).

14. The knitting machine according to claim 1, wherein:

each of the pre-selection elements (5) is vertically movable, as a result of an ascending motion of the respective needle (N), to a pre-selection configuration in which said connecting portion (6) is engaged into a connecting seat (9) defined in the sinker (P) belonging to the same needle-sinker assembly (1), thus causing a pre-selection of the sinker (P) with the ascending motion of the corresponding needle (N);

each of the activation elements (7) is horizontally movable, towards said central axis (X), until acting upon the corresponding pre-selection element (5) belonging to the same needle-sinker assembly (1), so that the connecting portion (6) of the pre-selection element (5), when engaged into the connecting seat (9) of the sinker (P), causes a movement of the sinker (P) in the corresponding radial groove (4) towards the central axis (X), thus performing an activation of the sinker.

* * * * *